US008522380B2

(12) United States Patent
Kim et al.

(10) Patent No.: US 8,522,380 B2
(45) Date of Patent: Sep. 3, 2013

(54) CONTROL METHOD OF WASHING MACHINE

(75) Inventors: Hyun Sook Kim, Suwon-si (KR); Seong Min Oak, Hwaseong-si (KR); Bo Ram Lee, Yongin-si (KR); Eun Suk Bang, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1145 days.

(21) Appl. No.: 12/385,671

(22) Filed: Apr. 15, 2009

(65) Prior Publication Data

US 2009/0241267 A1 Oct. 1, 2009

Related U.S. Application Data

(63) Continuation-in-part of application No. 11/785,889, filed on Apr. 20, 2007.

(30) Foreign Application Priority Data

Jun. 19, 2006 (KR) ..... 2006-54933
Sep. 1, 2006 (KR) ..... 2006-84407

(51) Int. Cl.
*D06F 33/00* (2006.01)
*D06F 39/02* (2006.01)
*D06F 35/00* (2006.01)

(52) U.S. Cl.
USPC ..... 8/159

(58) Field of Classification Search
USPC ..... 8/158–159; 68/12.05, 12.18, 12.19, 68/12.21, 17 R, 23 R, 24
See application file for complete search history.

(56) References Cited

U.S. PATENT DOCUMENTS

| | | | |
|---|---|---|---|
| 1,948,568 | A | 4/1930 | Faber et al. |
| 2,023,013 | A | 12/1935 | Faber et al. |
| 4,118,189 | A | 10/1978 | Reinwald et al. |
| 5,253,380 | A | 10/1993 | Lim et al. |
| 5,307,649 | A | 5/1994 | Lim et al. |

(Continued)

FOREIGN PATENT DOCUMENTS

| | | | |
|---|---|---|---|
| CN | 1389620 | A | 1/2003 |
| CN | 1478943 | A | 3/2004 |

(Continued)

OTHER PUBLICATIONS

U.S. Office Action dated Nov. 17, 2010, issued in the file history of U.S. Appl. No. 11/785,889.

(Continued)

*Primary Examiner* — Joseph L. Perrin
(74) *Attorney, Agent, or Firm* — Staas & Halsey LLP

(57) ABSTRACT

Disclosed herein is a control method of a washing machine that performs washing using bubbles. The control method may generate a large number of bubbles using a small amount of water to reduce water consumption and transmit detergent water to laundry placed in the washing machine effectively and rapidly using high-concentration detergent on the surfaces of the bubbles, thereby reducing time and energy consumption and improving washing efficiency. The bubbles may act as a cushion to reduce friction between laundry articles, thereby preventing expensive laundry (such as wool or silk) from being damaged due to the friction between the laundry articles and between the laundry and water and preventing damage to and deformation of general laundry when washing the laundry.

9 Claims, 17 Drawing Sheets

(56) References Cited

U.S. PATENT DOCUMENTS

| | | | | |
|---|---|---|---|---|
| 5,653,129 | A | 8/1997 | Jang | |
| 2003/0208852 | A1 | 11/2003 | Hardaway et al. | |
| 2004/0040344 | A1 | 3/2004 | Minayoshi et al. | |
| 2004/0154645 | A1 | 8/2004 | Kim | |
| 2005/0081308 | A1 | 4/2005 | Kim et al. | |
| 2006/0000242 | A1 | 1/2006 | Yang et al. | |
| 2006/0101587 | A1 | 5/2006 | Hong | |
| 2007/0113595 | A1* | 5/2007 | Harwood et al. | 68/12.01 |
| 2007/0130700 | A1* | 6/2007 | Cho et al. | 8/158 |
| 2009/0272155 | A1 | 11/2009 | Jeong et al. | |

FOREIGN PATENT DOCUMENTS

| | | |
|---|---|---|
| JP | 2002-306886 | 10/2002 |
| JP | 2005-7224 | 1/2005 |
| KR | 2005-39590 | 4/2005 |
| WO | 2006/129912 | 12/2006 |

OTHER PUBLICATIONS

U.S. Office Action dated Nov. 18, 2010, issued in the file history of U.S. Appl. No. 12/588,548.

U.S. Office Action dated Feb. 10, 2012, issued in the file history of U.S. Appl. No. 11/785,889.

European Search Report dated Jan. 12, 2010 issued in corresponding European Patent Application 07107080.9.

U.S. Office Action mailed Feb. 5, 2010 in related U.S. Appl. No. 11/785,889.

U.S. Appl. No. 11/785,889, filed Apr. 20, 2007, Hyun Sook Kik, et al., Samsung Electronics Co., Ltd.

U.S. Office Action dated Mar. 22, 2011, issued in the file history of U.S. Appl. No. 11/785,889.

U.S. Office Action dated Apr. 29, 2011, issued in the file history of U.S. Appl. No. 12/588,548.

European Search Report dated Jan. 12, 2010, issued in corresponding European Patent Application No. 0710708.9.

Chinese Office Action dated Aug. 7, 2009, issued in corresponding Chinese Patent Application No. 2007101023602.

U.S. Office Action dated Jul. 15, 2009, issued in the file history of U.S. Appl. No. 11/785,889.

U.S. Office Action dated Feb. 5, 2010, issued in the file history of U.S. Appl. No. 11/785,889.

U.S. Advisory Action dated Apr. 23, 2010, issued in the file history of U.S. Appl. No. 11/785,889.

U.S. Office Action dated Jul. 23, 2010, issued in the file history of U.S. Appl. No. 11/785,889.

U.S. Appl. No. 11/785,889, filed Apr. 20, 2007, Seong Min Oak et al., Samsung Electronics Co., Ltd.

U.S. Appl. No. 12/588,548, filed Oct. 19, 2009, Seong Min Oak et al., Samsung Electronics Co., Ltd.

Chinese Office Action dated Jun. 17, 2010, issued in corresponding Chinese Patent Application No. 200710102360.2.

U.S. Final Office Action dated Aug. 16, 2011, issued in the file history of U.S. Appl. No. 11/785,889.

Chinese Office Action issued Aug. 7, 2009 in corresponding Chinese Patent Application 20071012360.2.

U.S. Office Action mailed Jul. 15, 2009 in related U.S. Appl. No. 11/785,889.

U.S. Office Action mailed Mar. 13, 2009 in related U.S. Appl. No. 11/785,889.

U.S. Office Action dated Nov. 8, 2012, issued in the file history of U.S. Appl. No. 12/588,548.

U.S. Notice of Allowance dated Jul. 12, 2012, issued in the file history of U.S. Appl. No. 11/785,889.

* cited by examiner

CONTROL METHOD OF WASHING MACHINE

CROSS-REFERENCE TO RELATED APPLICATION

This is a continuation-in-part of prior U.S. application Ser. No. 11/785,889, filed on Apr. 20, 2007, now pending, to which the benefit is claimed under 35 U.S.C. §120. This application also claims the benefit of Korean Patent Application No. 2006-0054933, filed on Jun. 19, 2006, and Korean Patent Application No. 2006-0084407, filed on Sep. 1, 2006, in the Korean Intellectual Property Office, the disclosures of which are incorporated herein by reference.

BACKGROUND

1. Field

Embodiments of the present invention relate to a control method of a washing machine that performs washing using bubbles.

2. Description of the Related Art

Generally, a washing machine (normally, a drum washing machine) is an apparatus, including a water tub to receive water (wash water or rinse water), a cylindrical drum rotatably installed in the water tub to receive laundry, and a motor to generate a drive force to rotate the drum, to lift the laundry in the drum along the inner wall of the drum and drop the lifted laundry, during the rotation of the drum, thereby washing the laundry.

The washing machine performs washing through a series of operations, e.g., a washing operation to separate contaminants from laundry with water containing detergent (specifically, wash water), a rinsing operation to rinse out bubbles or residual detergent from the laundry with water containing no detergent (specifically, rinse water), and a spin-drying operation to spin-dry the laundry at high velocity. In the washing operation, when a user selects a washing course, the washing machine detects the weight (load) of the laundry to decide the amount of wash water, supplies detergent and water sufficient to wet the laundry into the water tub according to the decided amount of wash water, and performs a washing operation by transmitting detergent water (water+detergent) to the laundry and dropping the laundry through the rotation of the drum.

During the washing operation, however, a large amount of water is used to sufficiently wet the laundry. Also, a large amount of detergent is used to perform high-concentration washing. For laundry requiring delicate washing, such as wool or silk, the laundry may be damaged due to dropping of the laundry and friction between the laundry and water and between laundry articles by the rotation of the drum.

SUMMARY

Therefore, it is an aspect of the present invention to provide a control method of a washing machine that generates a large number of bubbles using a small amount of water to reduce water consumption and improves washing efficiency through washing using high-concentration detergent on the surfaces of the bubbles.

Additional aspects of the invention will be set forth in part in the description which follows and, in part, will be obvious from the description, or may be learned by practice of the invention.

In accordance with one aspect of the present invention, a control method of a washing machine includes supplying water and detergent into a water tub to form detergent water, generating air bubbles using the detergent water, injecting the air bubbles into the detergent water to generate bubbles, and washing laundry using the bubbles.

A level of the detergent water supplied into the water tub may be lower than the bottom of a drum.

The control method may further include detecting a level of the detergent water initially supplied into the water tub, and a supply of the detergent water may be stopped when the level of the detergent water reaches a predetermined bubble generation level.

The bubble generation level may be a level to generate bubbles while not wetting at least some of the laundry.

The bubble generation level may be a level about 5 cm or less higher than a bottom of the drum in which the laundry is placed. When the generation of the bubbles is stabilized, the level of the detergent water may be lowered to below the bottom of the drum.

The generating the air bubbles may include injecting the air bubbles into a space between the water tub and the drum through a circulation channel to circulate the detergent water.

The control method may further include dispersing the air bubbles injected into the space between the water tub and the drum into the drum through holes formed in the drum.

The air bubbles injected into the space between the water tub and the drum may rise to the surface of the detergent water between the water tub and the drum to form bubbles, and the bubbles may be dispersed into the drum through holes formed in the drum while moving up to an upper part of the space between the water tub and the drum.

The generating the bubbles may include generating bubbles at a surface of the detergent water through combination between the air bubbles dispersed into the drum and the detergent.

The generating the bubbles may include generating the bubbles to raise a level defined by the bubbles such that the level defined by the bubbles is higher than that of the detergent water initially supplied into the water tub.

The control method may further include counting bubble generation time, and generation of the bubbles may be stopped when a predetermined time has elapsed as a result of counting the bubble generation time.

The control method may further include detecting the level defined by the bubbles, and generation of the bubbles may be stopped when the level defined by the bubbles reaches a predetermined bubble detection level.

The bubble detection level may be a level to sufficiently wet the laundry.

The control method may further include rotating the drum when the level defined by the bubbles reaches the bubble detection level.

The control method may further include stopping the generation of the bubbles during the rotation of the drum.

The control method may further include continuing the generation of the bubbles during the rotation of the drum.

In accordance with another aspect of the present invention, a control method of a washing machine includes supplying water and detergent into a water tub to form detergent water, generating air bubbles in the water tub using the detergent water, allowing the air bubbles to pass through a plurality of holes formed in the drum, combining the air bubbles with the detergent to form bubbles, stacking the bubbles on a surface of the detergent water, and allowing the bubbles to be absorbed into laundry.

The control method may further include driving a bubble generating device to generate the bubbles, and the bubble generating device may circulate the detergent water in the water tub to generate the bubbles.

The control method may further include forming the bubbles in a space between the water tub and the drum, and the bubbles formed in the space between the water tub and the drum may be introduced into the drum through the holes of the drum.

The control method may further include introducing the bubbles formed in the space between the water tub and the drum into the drum through rear holes formed in a rear of the drum, and the bubbles may be introduced into the drum from a bottom, a side, and the rear of the drum.

In accordance with another aspect of the present invention, a method of a washing machine includes supplying water and detergent into a water tub to form detergent water, mixing air bubbles in detergent water being circulated via a pump, injecting the air bubbles mixed detergent water into the water tub via the pump to generate bubbles, and washing laundry using the bubbles.

In accordance with another aspect of the present invention, a method of a washing machine includes supplying water and detergent into a water tub to form detergent water, circulating detergent water in the water tub via a pump, introducing air using pressure differential generated via the circulating detergent water, mixing the introduced air with detergent water being circulated via the pump, injecting the air bubbles mixed detergent water into the water tub via the pump to generate bubbles, and washing laundry using the bubbles.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
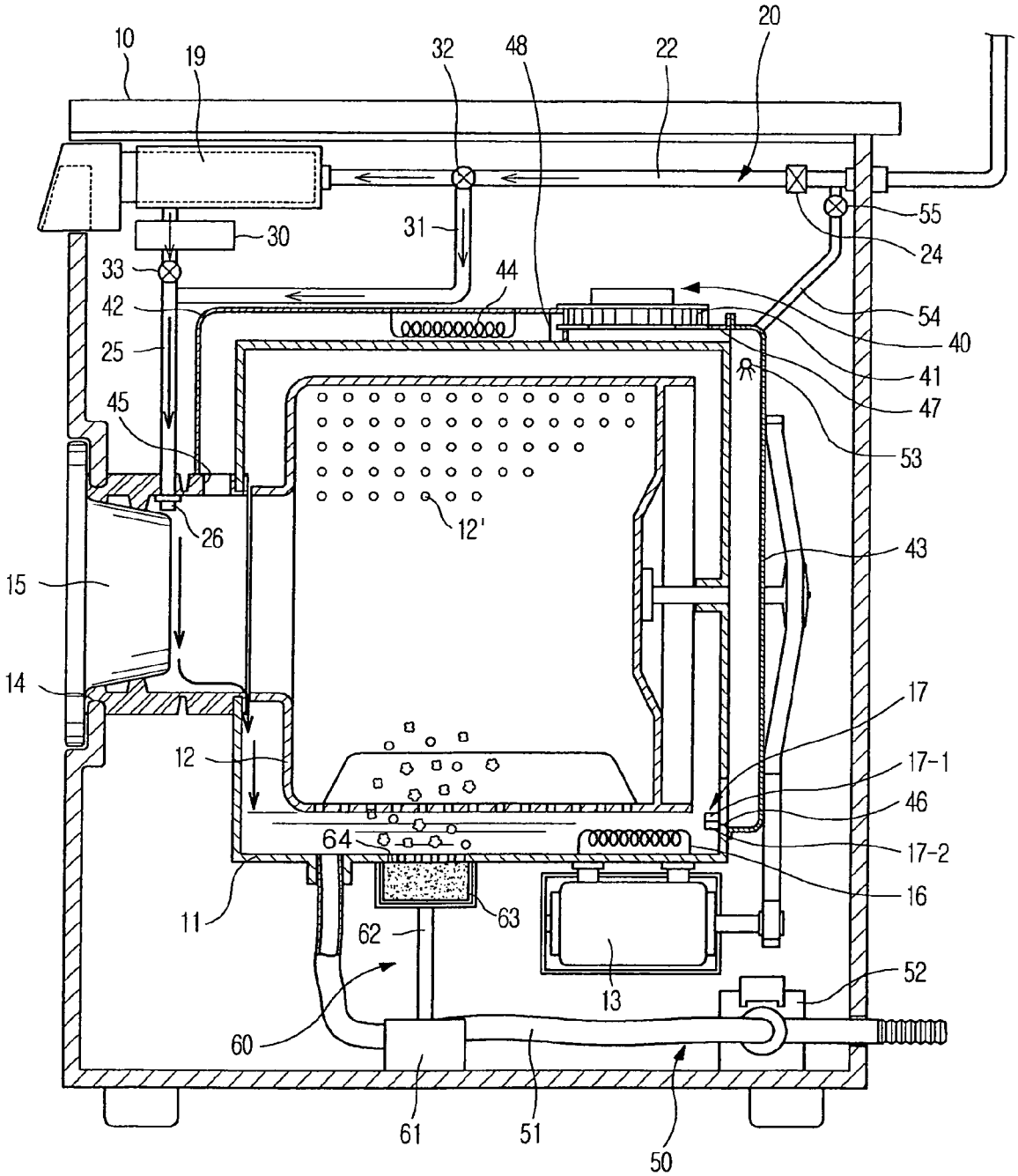
FIG. 1 is a sectional view illustrating the structure of a washing machine according to an embodiment of the present invention.

Reference will now be made in detail to the embodiments of the present invention, examples of which are illustrated in the accompanying drawings, wherein like reference numerals refer to the like elements throughout.

FIG. 1 is a sectional view illustrating the structure of a washing machine according to an embodiment of the present invention.

In FIG. 1, the washing machine includes a drum-type water tub 11 mounted in a machine body 10 to receive water (wash water or rinse water) and a cylindrical drum 12 rotatably mounted in the water tub 11. The drum 12 has a plurality of holes 12'.

The water tub 11 is provided with a motor 13 positioned therebelow to rotate the drum 12 in the clockwise or counterclockwise direction to perform washing, rinsing and spin-drying operations, a washing heater 16 positioned at a lower portion of the water tub 11 to heat water (specifically, detergent water) supplied into the water tub 11, and a level detection unit 17 to detect an amount (level) of the water (specifically, detergent water) supplied into the water tub 11.

The level detection unit 17 includes a first level sensor 17-1 to detect the maximum level (hereinafter, a first level) to prevent the detergent water from flowing into the drum 12, in which laundry is placed, to perform washing with bubbles and a second level sensor 17-2 to detect the minimum level (hereinafter, a second level) necessary to generate bubbles. Through detection of the level detection unit 17, supply of liquid detergent concentrate and water is controlled to be stopped to prevent the detergent water from flowing into the drum 12 when the detergent water reaches the first level upon washing or to be performed to resupply detergent water necessary to generate bubbles when the detergent water is gradually lowered to the second level due to the generation of bubbles.

The level detection unit 17 allows the detergent water to be maintained at a bubble generation level which permits generation of bubbles while preventing the detergent water from contacting the laundry through continuous detection of the level in addition to the detection of the first and second levels. In addition, with help of the level detection unit 17, liquid detergent concentrate and water are supplied at amounts necessary to generate bubbles having a predetermined detergent concentration by measuring a reduced level through flow or time control during bubble washing.

The machine body 10 has an opening 14 in front of the water tub 11 and the drum 12 such that laundry may be removed from the front of the machine body 10 and a door 15 to open or close the opening 14.

The washing machine further includes a detergent supply device 19 positioned above the water tub 11 to supply detergent, a detergent dissolving device 30 to generate and store a predetermined amount of liquid detergent concentrate used to generate bubbles having a predetermined detergent concentration, and a water supply device 20 to supply water into the detergent supply device 19 and the detergent dissolving device 30.

The detergent supply device 19 has a plurality of partitioned spaces. The detergent supply device 19 is mounted at the front side of the machine body 10 such that a user may easily place detergent and rinse in the respective partitioned spaces.

The water supply device 20 includes a water supply pipe 22 to supply water and a water supply valve 24 positioned on the water supply pipe 22 to control supply of water through the water supply pipe 22. The water supply pipe 22 is connected to the detergent supply device 19 such that water is supplied from an outside to the detergent supply device 19. The detergent dissolving device 30 is connected between the detergent supply device 19 and the water tub 11 such that water passes through the detergent supply device 19 and is then supplied along with detergent into the detergent dissolving device 30 to generate liquid detergent concentrate (in a state wherein the detergent is concentrated in the water) to generate bubbles having a predetermined detergent concentration. A separate connection pipe 25 is connected between the detergent dissolving device 30 and the water tub 11, and has a water supply nozzle 26 positioned at an exit of the connection pipe 25 to allow the liquid detergent concentrate to be supplied from the detergent dissolving device 30 to the water tub 11. This is for the purpose of allowing the liquid detergent concentrate in the detergent dissolving device 30 to be supplied together with the water into the water tub 11 and form detergent water used to generate bubbles having a predetermined concentration between the water tub 11 and the drum 12.

The detergent dissolving device 30 is connected to the detergent supply device 19 to form a predetermined amount of liquid detergent concentrate necessary to generate bubbles and to supply the predetermined amount of liquid detergent concentrate between the water tub 11 and the drum 12, such that the liquid detergent concentrate (water with the liquid detergent concentrate dissolved at a high concentration therein) is supplied together with the water to prevent the concentration of the bubbles from varying from an initial concentration of the bubbles when water is additionally supplied through the water supply device 20 due to lack of the detergent water (water with the liquid detergent concentrate dissolved therein) resulting from generation of the bubbles. To this end, the detergent dissolving device 30 includes an assistant water supply pipe 31 connected to one side of the water supply pipe 22 connected to the detergent dissolving device 30 to allow water to be additionally supplied to the water tub 11 without passing through the detergent supply device 19, an assistant water supply valve 32 mounted at the assistant water supply pipe 31 to control additional supply of water to the water tub 11, and a detergent liquid input valve 33 to control liquid detergent concentrate of a high concentration in the detergent dissolving device 30 to be supplied by an amount necessary to generate bubbles having a predetermined concentration.

The assistant water supply valve 32 is a three-way valve to control the direction of water such that the water is supplied to the detergent supply device 19 or the assistant water supply pipe 31 through the water supply pipe 22. The assistant water supply valve 32 adjusts the supplying direction of water in such a way that, after a small amount of water (that is, an amount of water sufficient to form the liquid detergent concentrate of the high concentration by dissolving the detergent of the detergent supply device 19) is supplied once into the detergent supply device 19 at an initial water supply stage, the water is directly supplied into the water tub 11 through the assistant water supply pipe 31 along with the liquid detergent concentrate formed in the detergent dissolving device 30, to form the liquid detergent concentrate in the detergent dissolving device 30 by dissolving the detergent of the detergent supply device 19.

The washing machine further includes a drying device 40 to dry laundry (clothes). The drying device 40 includes a drying fan 41 on the water tub 11, a drying duct 42 connected between an outlet 48 of the drying fan 41 and an air induction port 45 formed on the opening 14 of the water tub 11, and a condensing duct 43 mounted on the rear side of the water tub 11 and connected between an air discharge port 46 formed at a lower portion of the rear side of the water tub 11 and an inlet 47 of the drying fan 41.

The drying device 40 includes a drying heater 44 positioned inside the drying duct 42 to supply hot air into the water tub 11 and a condensing device positioned on the condensing duct 43 to allow vapor generated when drying clothes to be condensed and removed while the vapor passes through the condensing duct 43.

The condensing device includes a cold water injection nozzle 53 positioned at an upper portion inside the condensing duct 43 to inject cooling water into the condensing duct 43, a cooling water supply pipe 54 connected to the water supply device 20 to supply cooling water to the cooling water injection nozzle 53, and a cooling water valve 55 mounted on the cooling water supply pipe 54. With this structure, the condensing device may enable an improvement in dehumidification effect to increase a contact area between humid air rising from a lower portion of the condensing duct 43 and the cooling water by allowing the cooling water from the cold water injection nozzle 53 positioned at the upper portion to flow to the lower portion of the condensing duct 43 along an inner surface of the condensing duct 43.

The washing machine further includes a drainage device 50 to drain water from the water tub 11 to the outside. The drainage device 50 includes a drainage pipe 51 connected to a lower surface of the water tub 11 to guide the water from the tub 11 to the outside and a drainage pump 52 provided to the drainage pipe 51.

The washing machine further includes an air supply device 60 to wash the laundry in the drum 12 with bubbles. The air supply device 60 includes an air motor 61 positioned below the water tub 11 to supply air, an air supply pipe 62 to transfer the air supplied from the air motor 61, and a porous member 63 positioned at an end of the air supply pipe 62 to disperse the air. After being generated by the air motor 61, air is dispersed through the porous member 63 via the air supply pipe 62, and generates air bubbles in detergent water as a mixture of liquid detergent concentrate and water to form bubbles, so that the laundry may be washed with the bubbles in the drum 12.

In addition, air holes 64 are formed through the water tub 11 in which the air supply device 60 is positioned, and allow air to flow from the air supply device 60 into the water tub 11 therethrough so that the air is introduced into a space between the water tub 11 and the drum 12 after being dispersed through the porous member 63.

Figure 2:
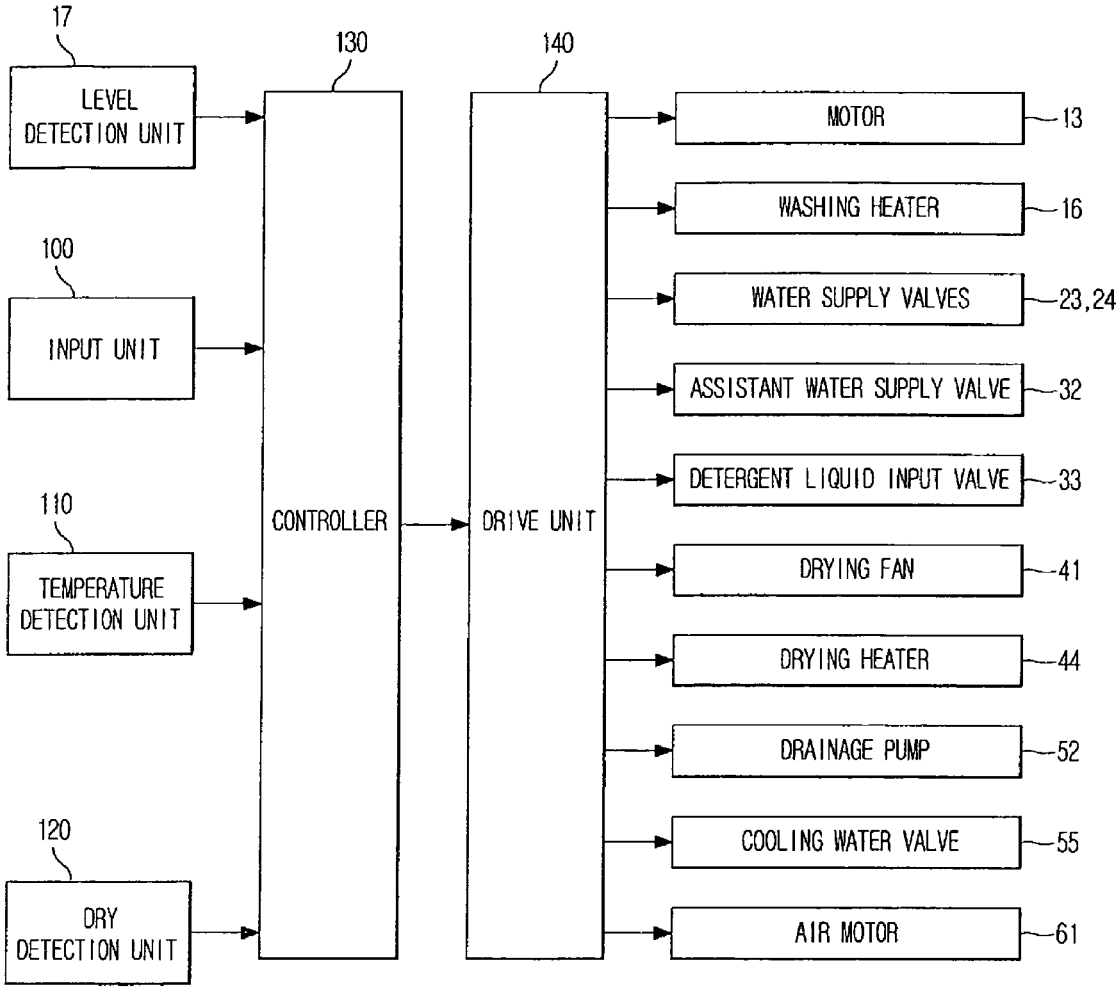
FIG. 2 is a control block diagram of the washing machine of FIG. 1.

FIG. 2 is a control block diagram of the washing machine of FIG. 1. The washing machine further includes an input unit 100, a temperature detection unit 110, a dry detection unit 120, a controller 130, and a drive unit 140.

The input unit 110 inputs operation information, such as a washing course (for example, a bubble washing course or a normal washing course), washing temperature, spin-drying RPM, and additional rinsing, which are selected by a user according to kinds of laundry to the controller 130. In the bubble washing course, selected information such as bubble concentration is input to the controller 130.

The temperature detection unit 110 serves to detect the temperature of water supplied into the water tub 11, and the dry detection unit 120 serves to detect a dried state of laundry through detection of the temperature and humidity of the laundry.

The controller 130 is a microprocessor to control the washing machine according to operation information input from the input unit 100, and stores motor RPM, motor operation rate (motor on-off time), and washing time, which are set depending on load (weight of laundry) in a selected washing course.

The controller 130 controls a motor 13, the water supply device 20, and the detergent dissolving device 30 to achieve optimum washing effect while reducing damage to the laundry by controlling supply amounts of water and liquid detergent concentrate together with generation of bubbles upon bubble washing, controlling the motor RPM and operation rate according to load, and by controlling a bubble concentration according to a contaminated degree of the laundry.

In addition, the controller 130 controls the motor RPM or driving of the water supply device 20 or drying device 40 to effectively remove bubbles after the bubble washing.

The drive unit 140 drives the motor 13, the washing heater 16, the water supply valves 23 and 24, the assistant water supply valve 32, the detergent liquid input valve 33, the drying fan 41, the drying heater 44, the drainage pump 52, and the air motor 61 in response to a drive control signal from the controller 130.

Hereinafter, a control method of the washing machine of FIG. 1 will be described.

The control method of the washing machine of FIG. 1 is to allow the washing machine to proceed a normal washing course to wash general laundry and a bubble washing course to wash delicate laundry (for example, wool or silk requiring delicate washing) through bubble washing. The input unit 100 of the washing machine includes a button with which a user may select the bubble washing course.

Figure 3:
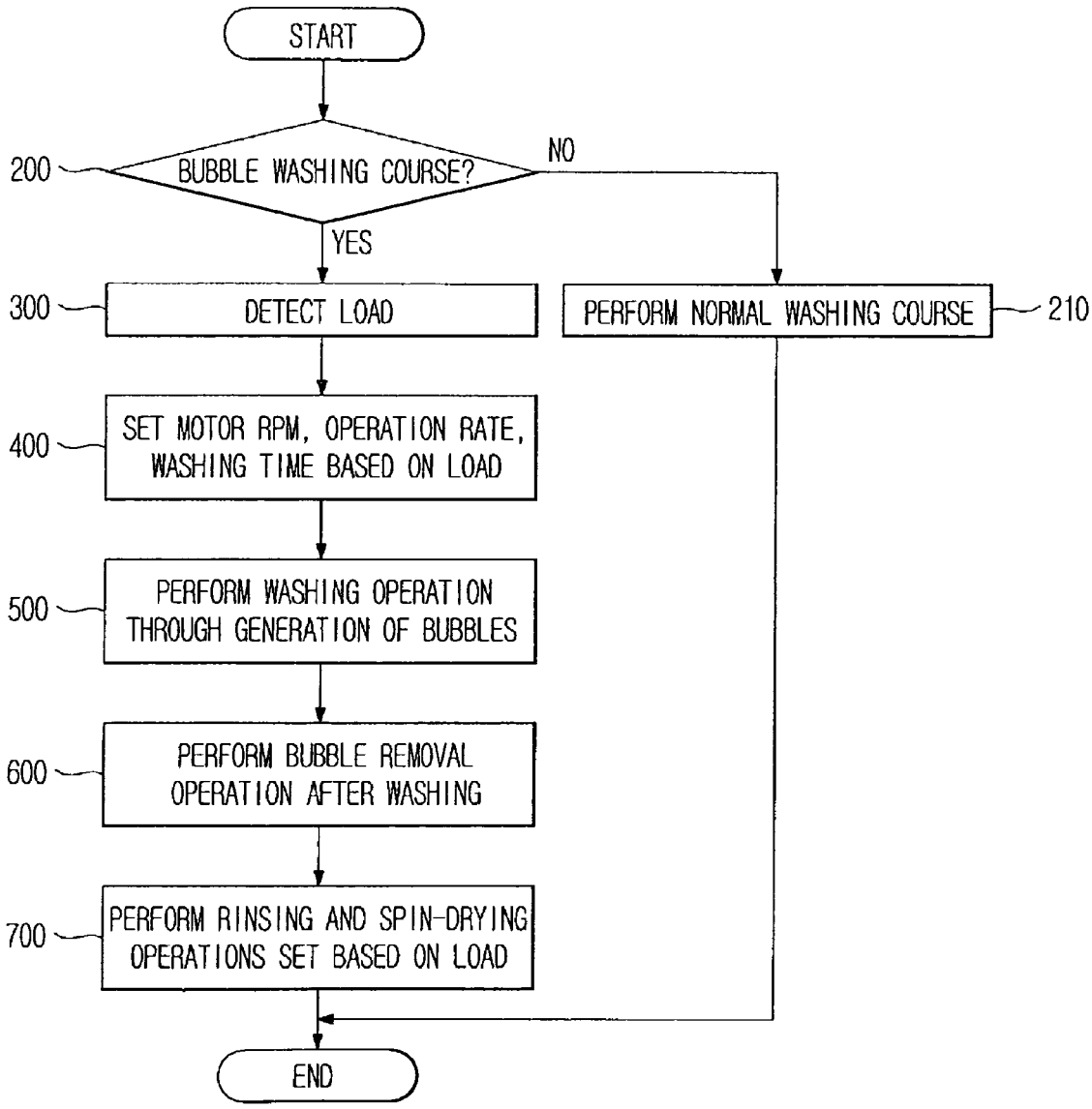
FIG. 3 is a flow chart illustrating an overall bubble washing control process of the washing machine of FIG. 1.

FIG. 3 is a flow chart illustrating an overall bubble washing control process of the washing machine of FIG. 1

With laundry put into the rotational drum 12, operation information such as a washing course (bubble washing or normal washing), a washing temperature, a spin-drying RPM, and additional rinsing, is selected by a user according to a kind of laundry, and is input to the controller 130 through the input unit 100.

The controller 130 determines whether or not the selected washing course is a bubble washing course in response to the operation information input from the input unit 100 (200), and controls the washing machine to perform the normal washing course in the same manner as a conventional washing course when it is determined that the selected washing course is not the bubble washing course (210).

When the selected washing course is the bubble washing course, the controller 130 detects load (weight of the laundry) in the drum 12 (300), and sets an amount of water, motor RPM and operation rate (motor on-off time), and washing time based on the detected load (400).

Then, the controller 130 allows the washing machine to perform a washing operation through generation of bubbles with the set motor RPM, the motor operation rate, and the washing time (500), and to perform a bubble removal operation to effectively remove the bubbles remaining in the drum 12 after the bubble washing operation (600).

As for the washing operation through the generation of the bubbles, the bubbles act as a cushion upon friction between laundry articles to reduce damage to the laundry due to the friction between the laundry articles and between the laundry and the water. In addition, a high detergent concentration of the bubbles may enable dirt on the laundry to be effectively removed with only a small amount of water, thereby reducing energy consumption.

After performing the washing operation through the generation of the bubbles and the bubble removal operation, rinsing and spin-drying operations set corresponding to the load are performed (700).

Next, the process (500) of performing the washing operation through the generation of bubbles will be described with reference to FIG. 4.

Figure 4:
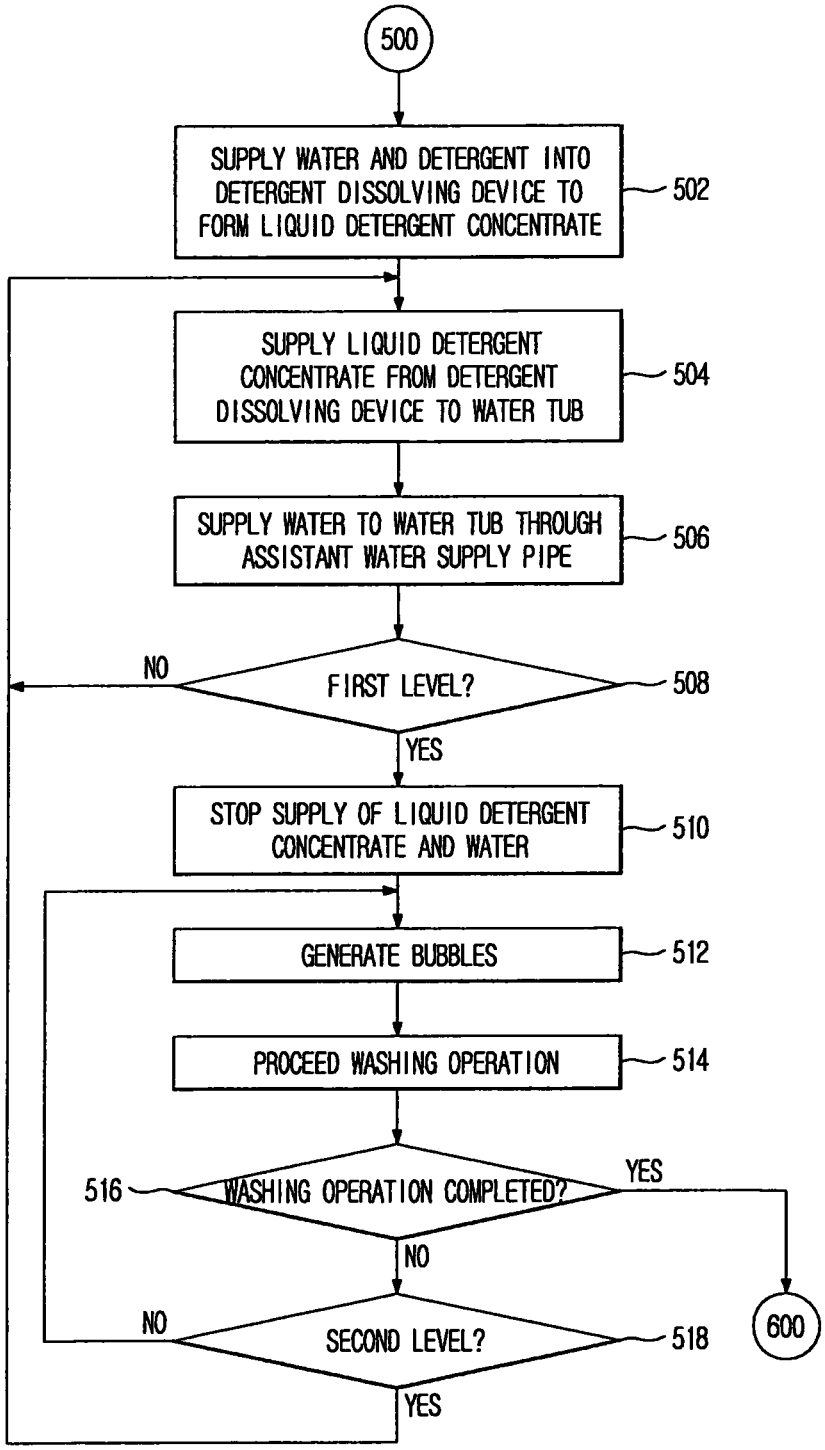
FIG. 4 is a flow chart illustrating a control process of a washing operation using bubbles in the washing machine of FIG. 1.

FIG. 4 is a flow chart illustrating a control process of a washing operation using bubbles in the washing machine of FIG. 1.

When a bubble washing course is selected, the controller 130 controls the water supply device 20 to allow a small amount of water necessary to dissolve detergent to be supplied into the detergent dissolving apparatus 30 through the detergent supply device 19 via the water supply valve 24 and the water supply pipe 22. At this time, the detergent in the detergent supply device 19 is introduced along with the water into the detergent dissolving device 30 while being dissolved by the water so that liquid detergent concentrate (that is, water with the detergent concentrated therein) is stored in the detergent dissolving device 30 (502).

Then, the controller 130 controls the detergent liquid input valve 33 to allow the liquid detergent concentrate in the detergent dissolving device 30 to be supplied into the water tub 11 through the water supply nozzle 26 via the connection pipe 25 (504), and controls the assistant water supply valve 32 to allow the water to be supplied into the water tub 11 through the connection pipe 25 and the water supply nozzle 26 via the assistant water supply pipe 31 without being supplied to the detergent supply device 19 (506).

As such, the control is performed in such a way that, after the small amount of water (that is, an amount of water sufficient to form liquid detergent concentrate of a high concentration by dissolving the detergent of the detergent supply device) is supplied once into the detergent supply device 19 at an initial water supply stage, the water is directly supplied into the water tub 11 through the assistant water supply pipe 31 along with the liquid detergent concentrate in the detergent dissolving device 30.

Although the liquid detergent concentrate and the water are illustrated as being sequentially supplied in FIG. 4 for easy understanding, operations of supplying the liquid detergent concentrate and the water may be performed simultaneously.

As the liquid detergent concentrate and the water are supplied into the water tub 11, detergent water as a mixture of the liquid detergent concentrate and the water is formed between the water tub 11 and the drum 12. At this time, a level of detergent water is detected by the level detection unit 17, and the controller determines whether or not the level of the detergent water is a first preset level (the maximum level of the detergent water to prevent water supplied into the tub from flowing into the drum, and corresponding to about ¼ of a level of detergent water in a normal washing operation; a level detected by the first level sensor) (508).

When the level of the detergent water is not the first level, liquid detergent concentrate and water are continuously supplied into the water tub 11 until the level of the detergent water reaches the first level. When the level of the detergent water is the first level, the controller 130 turns off the water supply valve 24, the assistant water supply valve 32, and the detergent liquid input valve 33 to stop supply of liquid detergent concentrate and water (510).

Subsequently, to wash the laundry using bubbles in the drum 12, air is supplied from the air supply device 60 to the detergent water formed of the mixture of liquid detergent concentrate and water to generate bubbles (512), followed by washing (514). At this time, the air supply device 60 generates the bubbles in such a way that, after being supplied from the air motor 61, air is dispersed through the porous member 62 via the air supply pipe 62, and is then forced into the detergent water as the mixture of liquid detergent concentrate and water through the air holes 64, generating the bubbles.

After being generated between the water tub 11 and the drum 12 via the air supply device 60, the bubbles are introduced into the drum 12 through the holes 12' or the front of the drum 12, and are finally dispersed into the overall space of the drum 12 after a predetermined time (about three minutes), enabling the laundry to be washed only with the bubbles in the drum 12.

When generating the bubbles, an RPM and operation rate of the drum 12 and washing time therein may be less than or equal to values set in each washing course corresponding to the load.

As such, dirt on the laundry may be effectively removed due to the high detergent concentration on the bubbles dispersed in the overall space of the drum 12. At this time, the bubbles may act as a cushion with respect to dropping of the laundry and friction between laundry articles caused by rotation of the drum 12, thereby preventing the laundry from being damaged due to the friction between the laundry articles.

Subsequently, it is determined whether or not the washing operation through the generation of the bubbles is completed (516). When the washing operation is completed, the procedure advances to Operation 600 to perform rinsing and spin-drying operations.

When the washing operation is not completed, the amount of detergent water is gradually reduced while the washing operation through the generation of the bubbles proceeds. At this time, the level detection unit 17 detects a level of the lowering detergent water, and determines whether or not the level of the detergent water reaches a second preset level (the minimum level of detergent water necessary to generate bubbles, corresponding to a level not less than the air supply device; a level detected by the second level sensor) (518).

When the level of the detergent water is not the second level, the procedure returns to Operation 512 to continue the washing operation through rotation of the drum 12 along with generation of the bubbles until the level of the detergent water reaches the second level. When the level of the detergent water is the second level, the procedure returns to Operation 504 to start supply of liquid detergent concentrate and water corresponding to a reduced amount of the detergent water.

Specifically, the water supply valve 24 and the assistant water valve 32 are opened with operation of the water supply device 20, allowing water to flow through the assistant water supply pipe 31 instead of the detergent supply device 19, and then to be additionally supplied into the water tub 11 through the water supply nozzle 26 via the connection pipe 25. At the same time, the detergent liquid input valve 33 is opened, allowing liquid detergent concentrate of a high detergent concentration in the detergent dissolving device 30 to be also supplied into the water tub 11.

That is, in the case where the amount of detergent water is reduced due to generation of the bubbles, if only water is supplied into the water tub without supplying detergent, it is difficult to generate bubbles having a predetermined detergent concentration due to a reduced detergent concentration on the bubbles. Thus, the predetermined amount of liquid detergent concentrate in the detergent dissolving device 30 is also supplied upon additional supply of the water.

The amount of the liquid detergent concentrate supplied from the detergent dissolving device 30 is determined so that, when 1 drop of liquid detergent concentrate having a predetermined concentration is supplied into the water tub 11, the water is also supplied at an amount proportional to this liquid detergent concentrate. For example, assuming an amount of detergent water required by the water tub 11 is 10, the controller controls the washing machine to supply 1 drop of liquid detergent concentrate and an amount of water proportional to this liquid detergent concentrate into the tub 11. Assuming an amount of detergent water required by the water tub 11 is 20, the controller controls the washing machine to supply 2 drops of liquid detergent concentrate and an amount of water proportional to this liquid detergent concentrate, that is, two times the above case, into the water tub 11.

As such, the control method may enable the bubble washing operation to be effectively performed always using the bubbles having the predetermined detergent concentration by allowing the predetermined amount of liquid detergent concentrate to be supplied together with additional supply of water into the water tub.

Next, the process (600) of removing bubbles remaining in the drum 12 after bubble washing will be described with reference to FIGS. 5 to 7.

Figure 5:
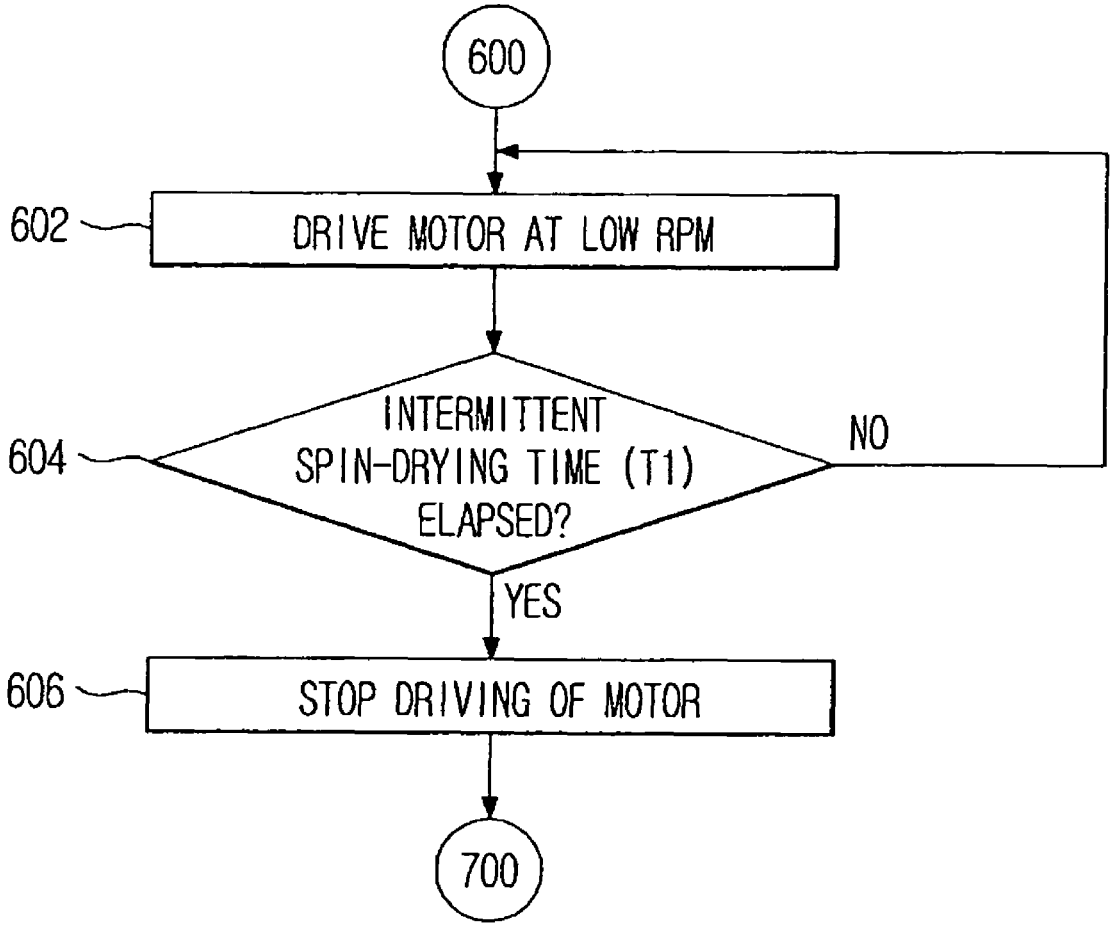
FIG. 5 is a flow chart illustrating a first operation to remove bubbles after bubble washing in the washing machine of FIG. 1.

FIG. 5 is a flow chart illustrating a first operation to remove bubbles after bubble washing in the washing machine of FIG. 1. In the first operation, after the detergent water is drained to the outside upon completion of the bubble washing operation, a bubble removal operation is performed to remove the bubbles remaining in the drum 12 instead of directly performing a rinsing operation.

After draining the water upon completion of the bubble washing operation, the bubbles are removed by intermittent spin-drying during which the motor 13 is driven at a low RPM (for example, about 400 RPM) (602).

It is determined whether or not a preset intermittent spin-drying time (T1: the minimum time necessary to remove the bubbles in the drum through the intermittent spin-drying) has elapsed by counting time for which the motor 13 is driven at the low RPM (604). When it is determined the preset intermittent spin-drying time has elapsed, driving of the motor 13 is stopped (606).

Figure 6:
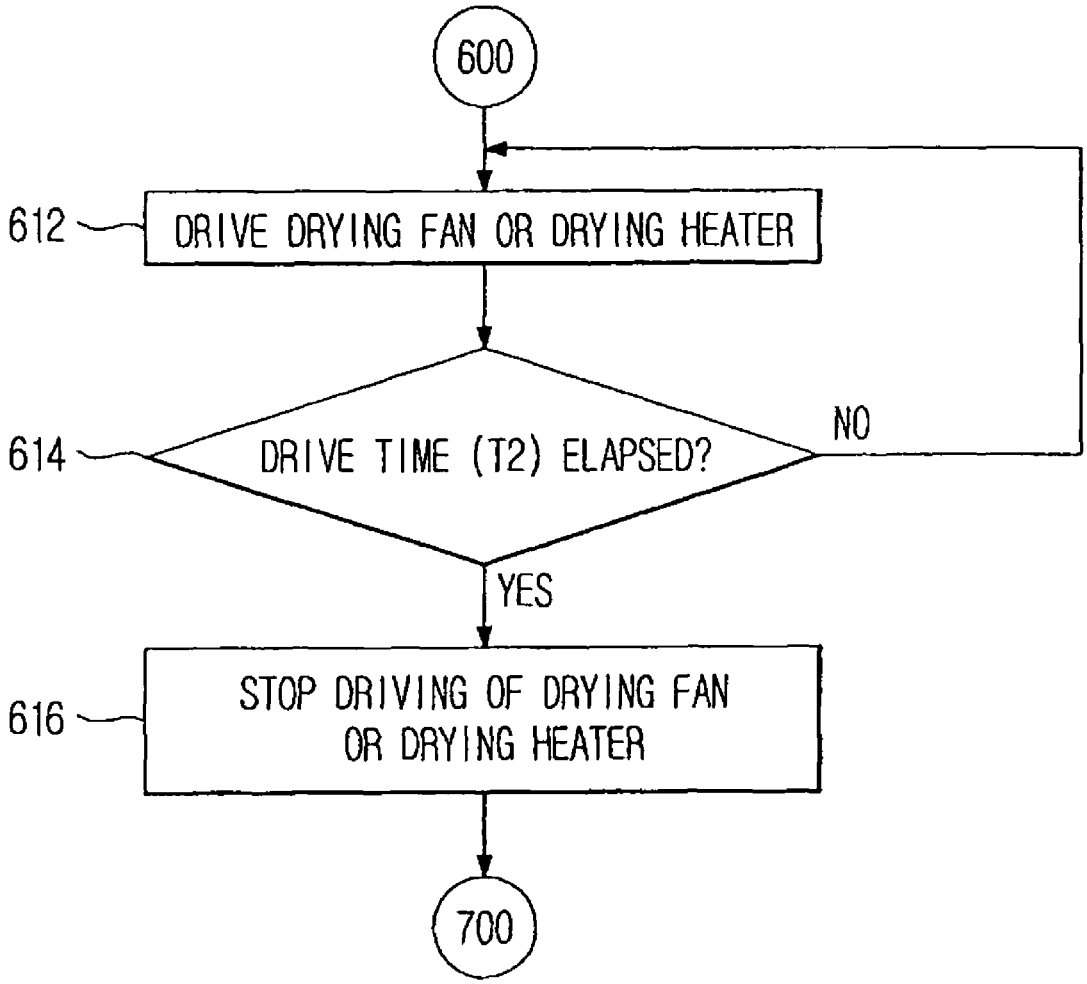
FIG. 6 is a flow chart illustrating a second operation to remove bubbles after bubble washing in the washing machine of FIG. 1.

FIG. 6 is a flow chart illustrating a second operation to remove bubbles after bubble washing in the washing machine of FIG. 1. In the second operation, after draining the detergent water upon completion of the bubble washing operation, the bubble removal operation is performed to remove the bubbles remaining in the drum 12 instead of directly entering the rinsing operation.

After draining the water or when blowing air through driving of the drying fan 41 simultaneously with water drainage, the drying heater 44 is driven to supply hot air, thereby removing the bubbles (612).

It is determined whether or not a preset drive time (T2: the minimum time necessary to remove the bubbles in the drum through air or hot air blowing) has elapsed by counting time for which the drying fan 41 or the drying heater 44 is driven (614). When it is determined the preset drive time has elapsed, the driving of the drying fan 41 or the drying heater 44 is stopped (616).

Figure 7:
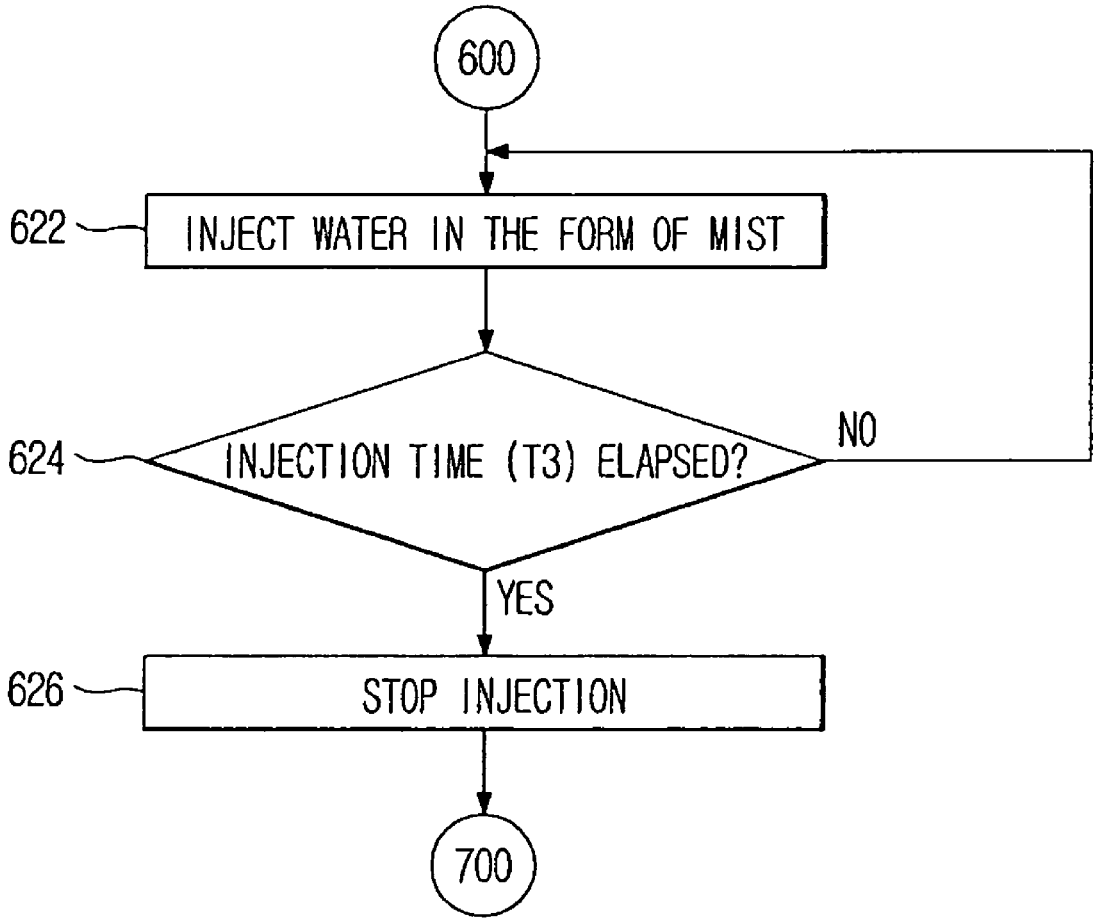
FIG. 7 is a flow chart illustrating a third operation to remove bubbles after bubble washing in the washing machine of FIG. 1.

FIG. 7 is a flow chart illustrating a third operation to remove bubbles after bubble washing in the washing machine of FIG. 1. In the third operation, after draining the detergent water upon completion of the bubble washing operation, the bubble removal operation is performed to remove the bubbles remaining in the drum 12 instead of directly entering the rinsing operation.

While separately or simultaneously performing the driving of the motor 13 at the low RPM and the driving of the drying fan 41 or the drying heater 44, the water supply device 20 is controlled to inject a small amount of water in the form of mist between the drum 12 and the water tub 11 through the water supply nozzle 26, thereby removing the bubbles (622).

It is determined whether or not a preset injection time (T3: the time necessary to remove the bubbles in the drum through mist injection) has elapsed by counting water injection time (624). When it is determined the preset injection time has elapsed, the mist injection is stopped (626), thereby completing the bubble removal operation.

Figure 8:
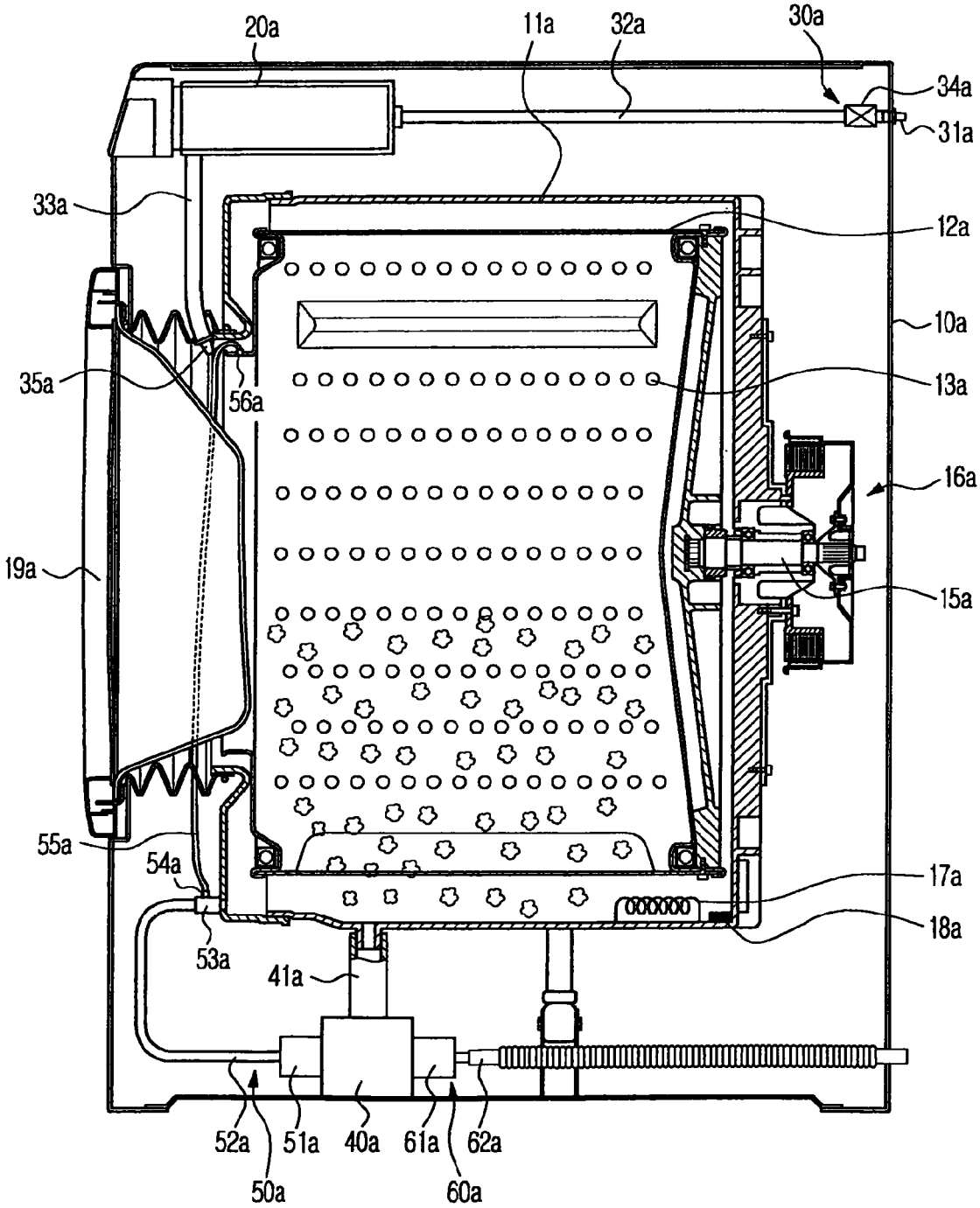
FIG. 8 is a sectional view illustrating the structure of a washing machine according to another embodiment of the present invention.

FIG. 8 is a sectional view illustrating the structure of a washing machine according to another embodiment of the present invention.

In FIG. 8, the washing machine includes a drum-type water tub 11*a* mounted in a machine body 10*a* to receive water (wash water or rinse water) and a cylindrical drum 12*a* rotatably mounted in the water tub 11*a*. The drum 12*a* has a plurality of holes 13*a*.

Outside the rear of the water tub 11*a* is mounted a drive device, such as a motor 16*a*, to rotate a rotary shaft 15*a* connected to the drum 12*a* such that washing, rinsing, and spin-drying operations are performed. At the inside bottom of the water tub 11*a* are mounted a washing heater 17*a* to heat water (specifically, detergent water) present in the water tub 11*a* and a level detection unit 18*a* to detect frequency variation depending upon the level and thus the amount (level) of water in the water tub 11*a*.

The level detection unit 18*a* controls a level (an optimum level necessary to generate bubbles, which is a level 5 cm or less higher than the bottom of the drum; hereinafter, referred to as a bubble generation level) at which detergent water does not sufficiently wet laundry placed in the drum 12*a*. When detergent water supplied during bubble washing reaches the bubble generation level, the supply of water (wash water) is stopped such that the detergent water is not introduced into the drum 12*a*.

At the front of the machine body 10*a* is mounted a door 19*a* having an inlet through which laundry is put into or removed from the drum 12*a*. Above the water tub 11*a* are mounted a detergent supply device 20*a* to supply detergent and a water supply device 30*a* to supply water (wash water or rinse water).

The detergent supply device 20*a* has a plurality of partitioned spaces. The detergent supply device 20*a* is mounted at the front side of the machine body 10*a* such that a user may easily place detergent and rinse in the respective partitioned spaces.

The water supply device 30*a* includes a first water supply pipe 32*a* connected between an external water supply pipe 31*a*, through which water (wash water or rinse water) is supplied into the water tub 11*a*, and the detergent supply device 20*a*, a second water supply pipe 33*a* connected between the detergent supply device 20*a* and the water tub 11*a*, a water supply valve 34*a* mounted on the first water supply pipe 32*a* to control the supply of water, and a water supply nozzle 35*a* mounted at the outlet of the second water supply pipe 33*a*. In this structure, water is supplied into the water tub 11*a* via the detergent supply device 20*a* such that detergent is supplied into the water tub 11*a* together with the water.

Also, a circulation device 50*a* to circulate the water in the water tub 11*a* and a drainage device 60*a* to drain the water in the water tub 11*a* are mounted at a pump case 40*a* below the water tub 11*a* in a symmetrical fashion. Between the water tub 11*a* and the pump case 40*a* is connected a connection hose 41*a* to guide the water in the water tub 11*a* to the pump case 40*a*.

The circulation device 50*a* includes a circulation pump 51*a* to supply the water guided to the pump case 40*a* into the water tub 11*a*, a circulation pipe 52*a* mounted at the outlet of the circulation pump 51*a* to circulate the water, a circulation nozzle 53*a* mounted at the outlet of the circulation pipe 52*a* to supply the water into the lower part of the water tub 11*a*, an air introduction hole 54*a* formed in the circulation nozzle 53*a* to introduce air necessary to generate bubbles into the water (specifically, detergent water) to be supplied into the lower part of the water tub 11*a*, and an air guide pipe 55*a* to guide air in the drum 12*a* to the air introduction hole 54*a* through an air suction hole 56*a*.

One side of the circulation pipe 52*a* is connected to the circulation pump 51*a*, and the other side of the circulation pipe 52*a* is connected to the water tub 11*a*. Upon driving the circulation pump 51*a*, the water in the water tub 11*a* is guided to the pump case 40*a* through the connection hose 41*a*. The water guided to the pump case 40*a* is resupplied into the water tub 11*a* through the circulation pipe 52*a*. In this way, water circulation is achieved. The circulation pipe 52*a* connected to the water tub 11*a* is mounted at the lowest possible position such that the circulated water is smoothly supplied to the lower part of the water tub 11*a*.

The circulation nozzle 53*a* is formed of a venturi that lowers the pressure of the circulated water. Air introduced through the air suction hole 56*a* is naturally introduced into the circulation nozzle 53*a* through the air introduction hole 54*a* via the air guide pipe 55*a* such that the detergent in the detergent water is formed into an aggregate to generate bubbles without an additional power device to supply air.

The drainage device 60*a* includes a drainage pump 61*a* to drain water guided to the pump case 40*a* to the outside and a drainage pipe 62*a* mounted at the outlet of the drainage pump 61*a* to drain the water.

In the washing machine of FIG. 8, the circulation device 50*a* to circulate water in the water tub 11*a* to generate bubbles may have the same effect as the air supply device 60 of FIG. 1. A bubble generation process in the washing machine of FIG. 8 will be described in more detail with reference to FIGS. 9 to 13.

FIGS. 9 to 13 are views illustrating a bubble generation process in the washing machine of FIG. 8.

Figure 9:
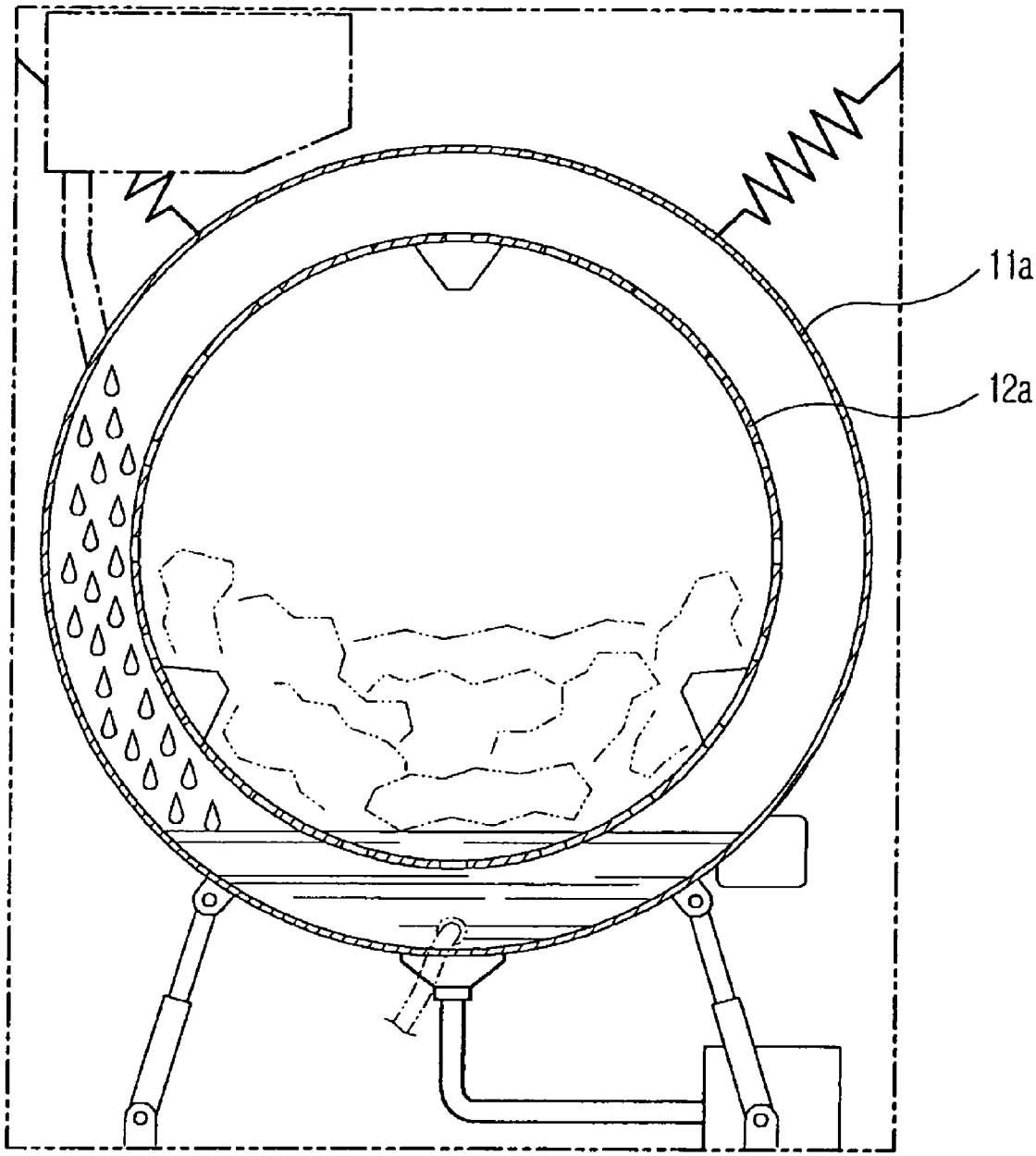
FIGS. 9 to 13 are views illustrating a bubble generation process in the washing machine of FIG. 8.

In FIG. 9, water, supplied through the water supply vale 34*a*, is introduced into the lower part of the water tub 11*a* together with detergent via the detergent supply device 20*a*, with the result that detergent water (water+detergent) is supplied into a space between the water tub 11*a* and the drum 12*a*. When the supplied detergent water reaches a bubble generation level (for example, a level 5 cm or less higher than the bottom of the drum), the supply of detergent water is stopped.

Figure 10:
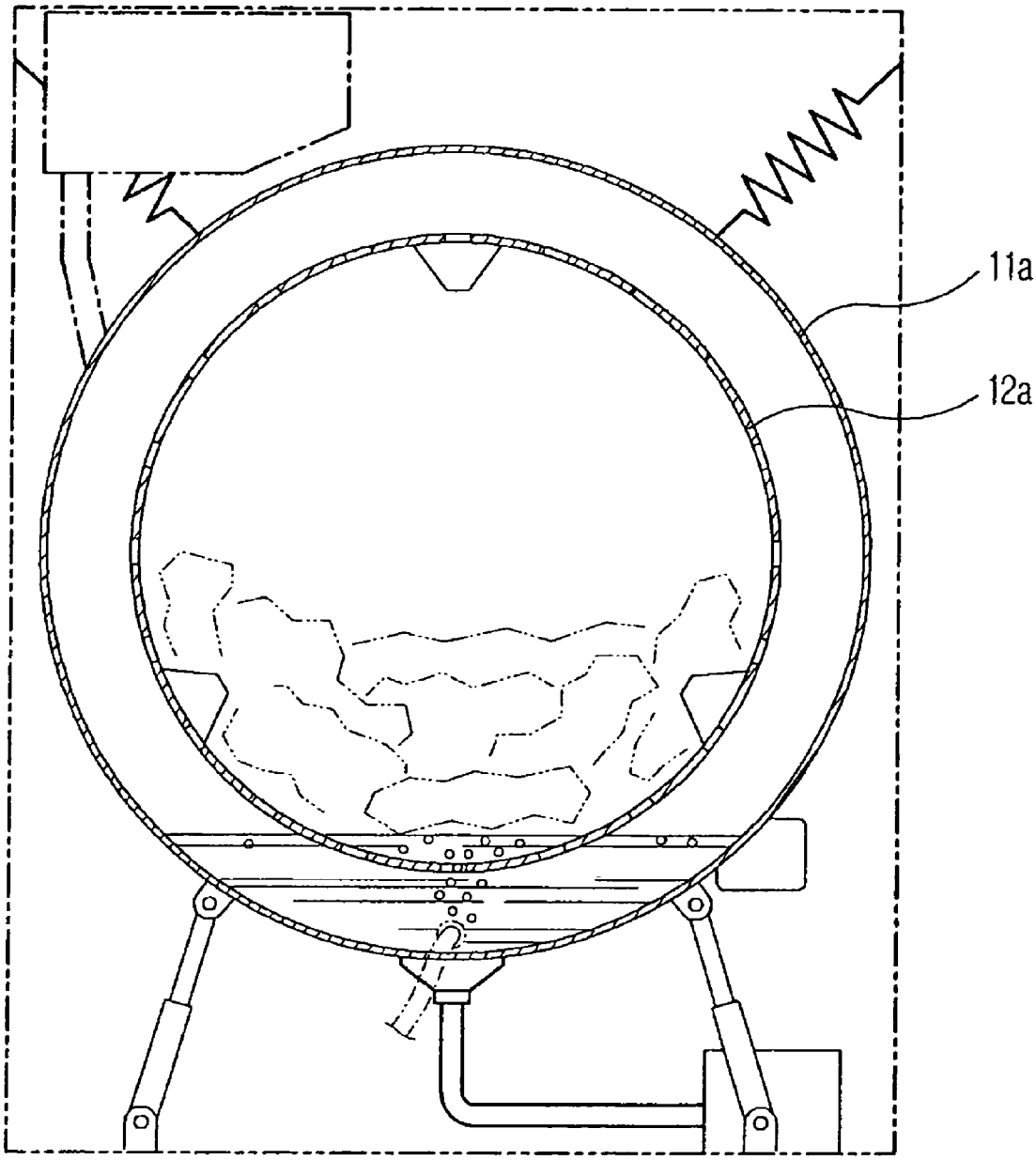

In FIG. 10, when the detergent water is supplied up to the bubble generation level, the circulation pump 50*a* is driven such that the detergent water discharged from the circulation pump 50*a* is introduced into the circulation nozzle 53*a* via the circulation pipe 52*a*. While passing through the circulation nozzle 53*a*, which is formed of a venturi that lowers the pressure of the detergent water, air in the drum 12*a* is introduced into the circulation nozzle 53*a* through the air introduction hole 54*a* by virtue of the expansion of a circulation channel. The air introduced into the circulation nozzle 53*a* is injected into a space between the water tub 11*a* and the drum 12 to generate air bubbles in the detergent water between the water tub 11*a* and the drum 12*a*.

Figure 11:
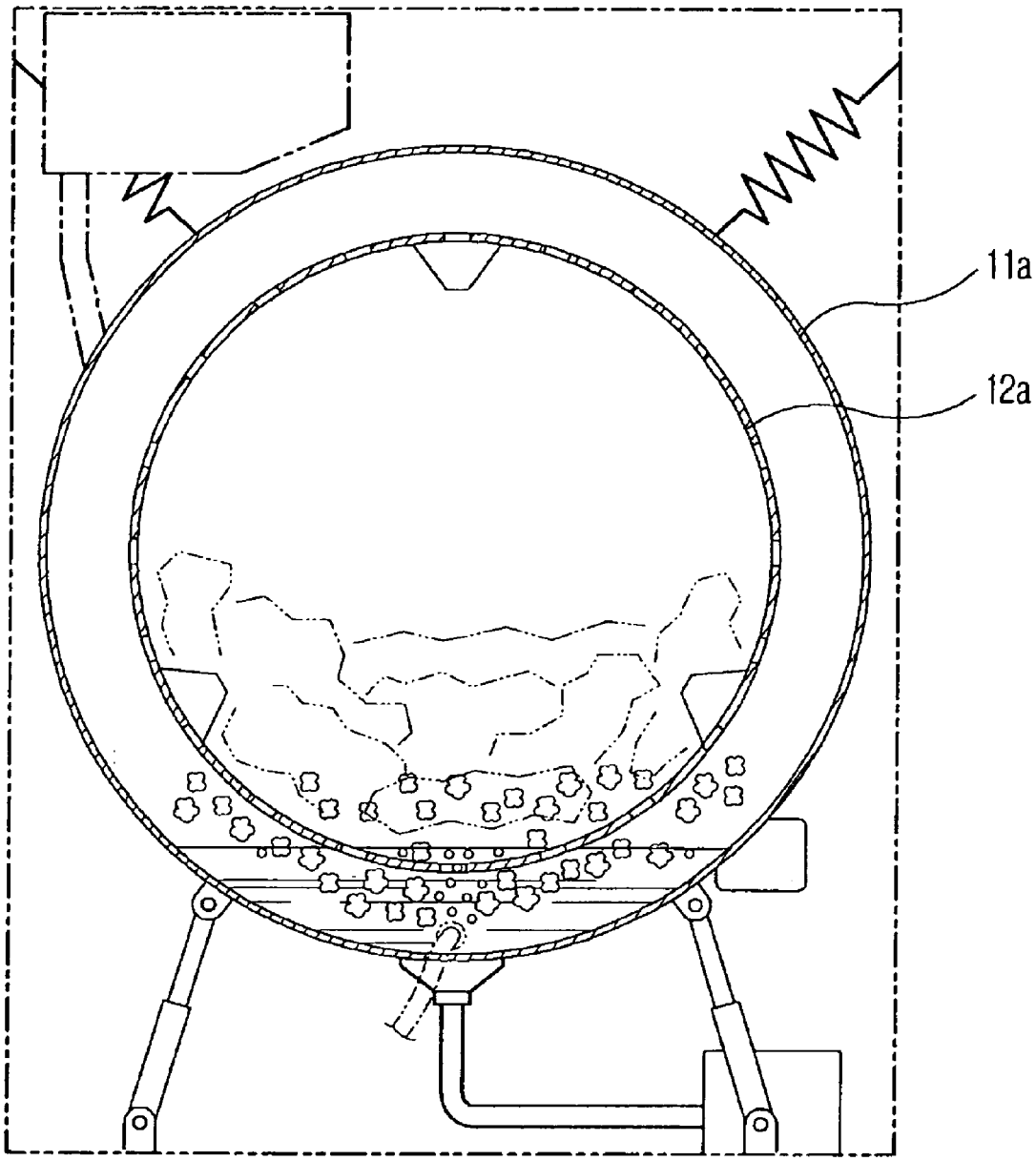

In FIG. 11, the air bubbles rise to the surface of the detergent water between the water tub 11*a* and the drum 12 to form bubbles. While moving up to the upper part of the space between the water tub 11*a* and the drum 12*a*, the bubbles are introduced into the drum 12*a* through the holes 13*a* of the drum 12*a*, and are dispersed in the drum 12*a* to generate bubbles as mixtures of the detergent and the air bubbles. The bubbles between the water tub 11*a* and the drum 12*a* pass through rear holes formed in the rear of the drum 12*a* or are introduced into the drum 12*a* from the bottom, the side, and the rear of the drum 12*a*.

Figure 12:
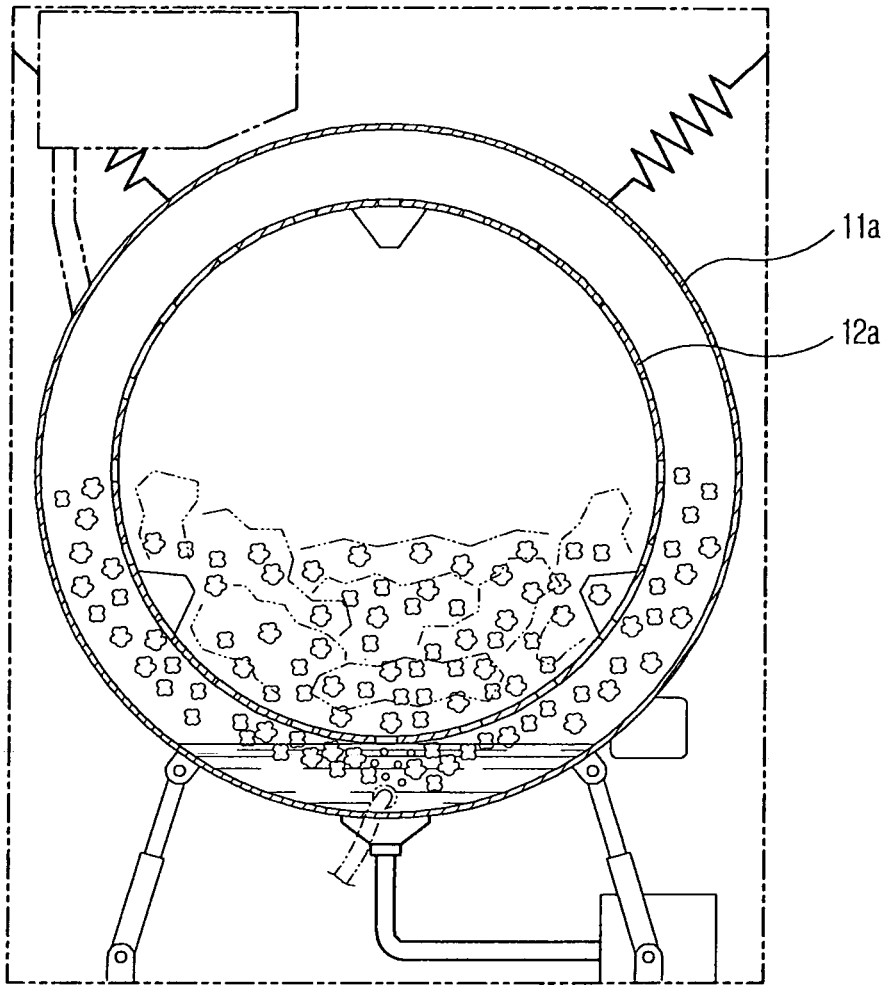

In FIG. 12, the bubbles as the mixtures of the detergent and the air bubbles are stacked from the surface of the detergent water, and start to rise in the drum 12*a*. After a predetermined time (about three minutes), the bubbles are dispersed throughout the drum 12*a*, with the result that a level defined by the bubbles rises. As the level defined by the bubbles rises, the bubbles surround laundry placed in the drum 12*a*, and the high-concentration detergent on the surfaces of the bubbles is absorbed into the laundry. When the generation of the bubbles is stabilized, the level of the detergent water is lowered to below the bottom of the drum 12*a*, i.e., a level between the water tub 11*a* and the drum 12*a*.

Figure 13:
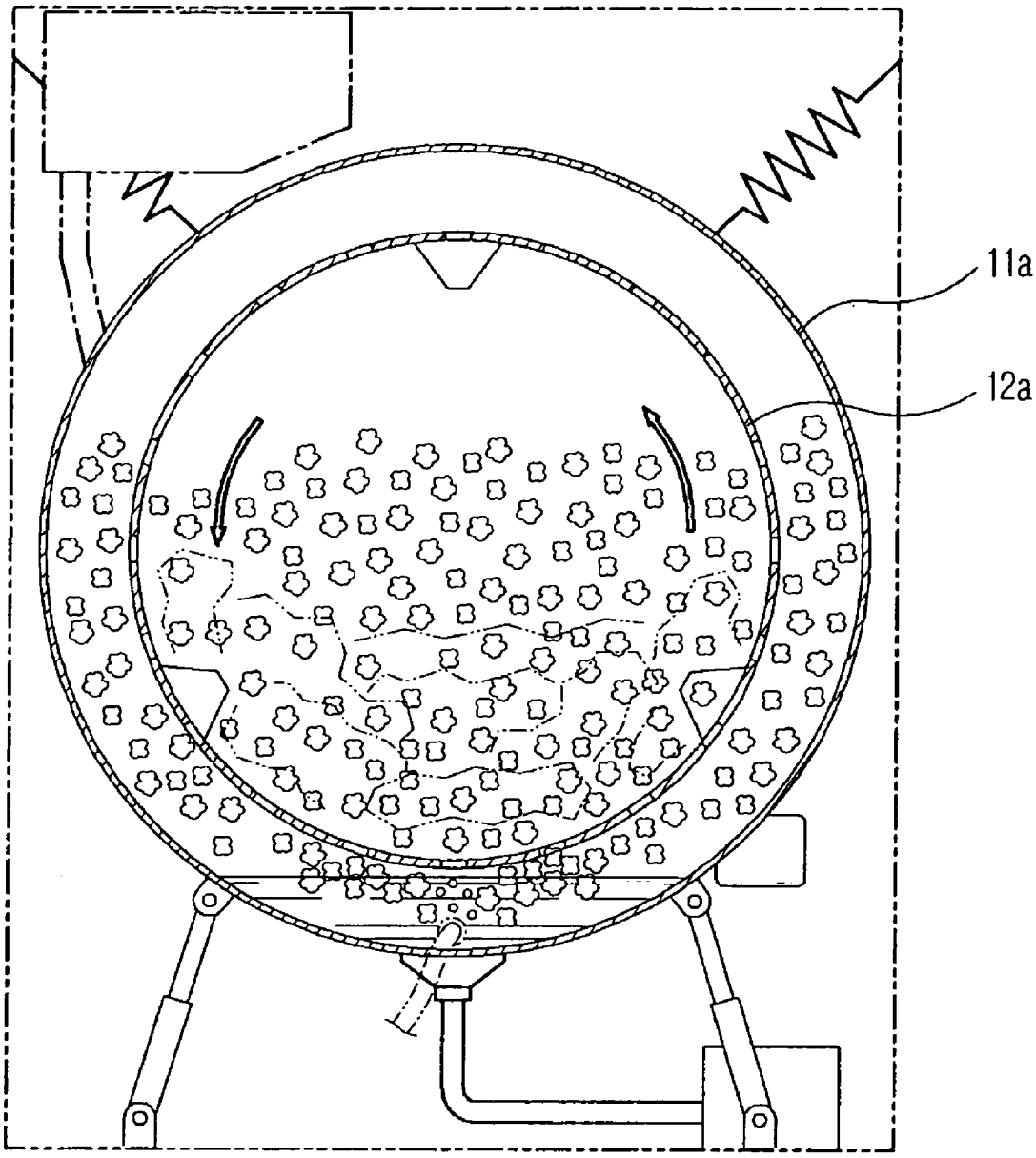

In FIG. 13, when the detergent water reaches a level to sufficiently wet the laundry placed in the drum 12*a* (an optimum level necessary to perform bubble washing, which is a level higher than the level of the laundry; hereinafter, referred to as a bubble detection level), the drum 12*a* is rotated such that the high-concentration detergent on the surfaces of the bubbles is rapidly absorbed into the laundry, thereby achieving the bubble washing of the laundry placed in the drum 12*a*.

Figure 14:
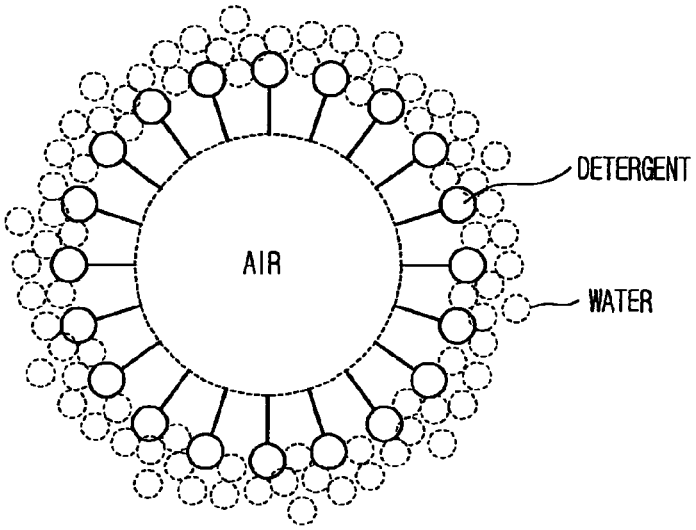
FIG. 14 is a view illustrating the shape of a bubble generated through the bubble generation process of FIGS. 9 to 13.

FIG. 14 is a view illustrating the shape of a bubble generated through the bubble generation process of FIGS. 9 to 13.

In FIG. 14, a bubble is a mixture of detergent, water, and air. The bubble easily bursts and is easily absorbed. Consequently, the bubble is rapidly absorbed into the laundry to effectively remove contaminants from the laundry.

Figure 15:
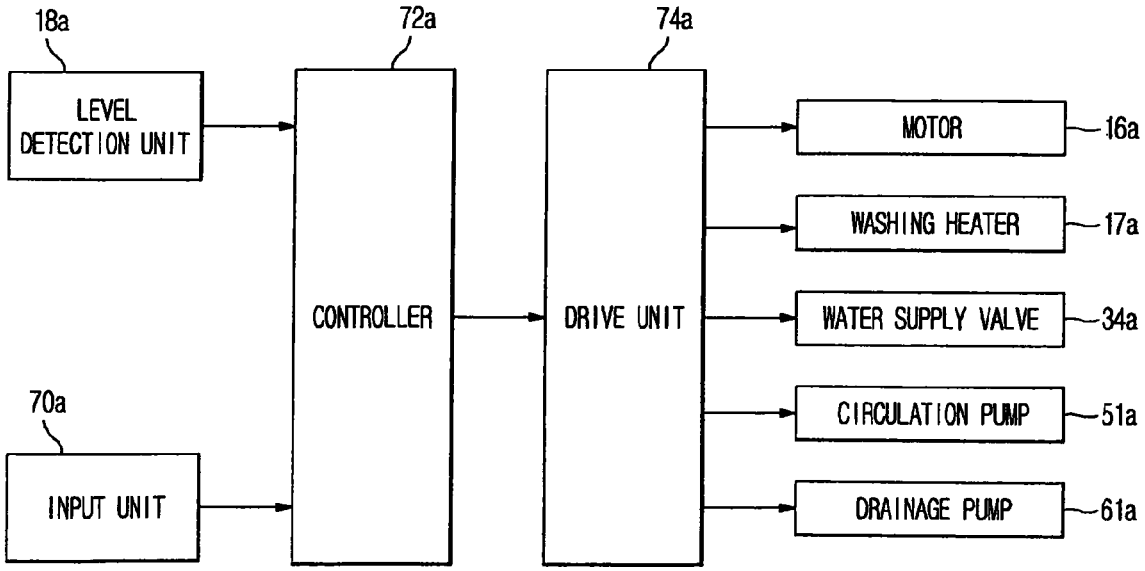
FIG. 15 is a control block diagram of the washing machine of FIG. 8.

FIG. 15 is a control block diagram of the washing machine of FIG. 8. The washing machine further includes an input unit 70*a*, a controller 72*a*, and a drive unit 74*a*.

The input unit 70*a* inputs operation information, such as a washing course (for example, normal washing or bubble washing), spin-drying RPM, and additional rinsing, which are selected by a user, to the controller 72*a*.

The controller 72*a* is a microcomputer to control the overall operations of the washing machine, such as washing, rinsing, and spin-drying, based on the operation information input from the input unit 70*a*. The controller 72*a* stores motor RPM, motor operation rate (motor on-off time), and washing time set according to the load (the weight of laundry) in the selected washing course.

For bubble washing, therefore, the controller 72*a* controls the motor RPM and the motor operation rate based on the load such that the motor 16*a* and the circulation pump 51*a* are driven to effectively perform the washing operation.

The drive unit 74*a* drives the motor 16*a*, the washing heater 17*a*, the water supply valve 34*a*, the circulation pump 51*a*, and the drainage pump 61*a* according to a drive control signal of the controller 72*a*.

Hereinafter, a control method of the washing machine of FIG. 8 will be described.

Figure 16:
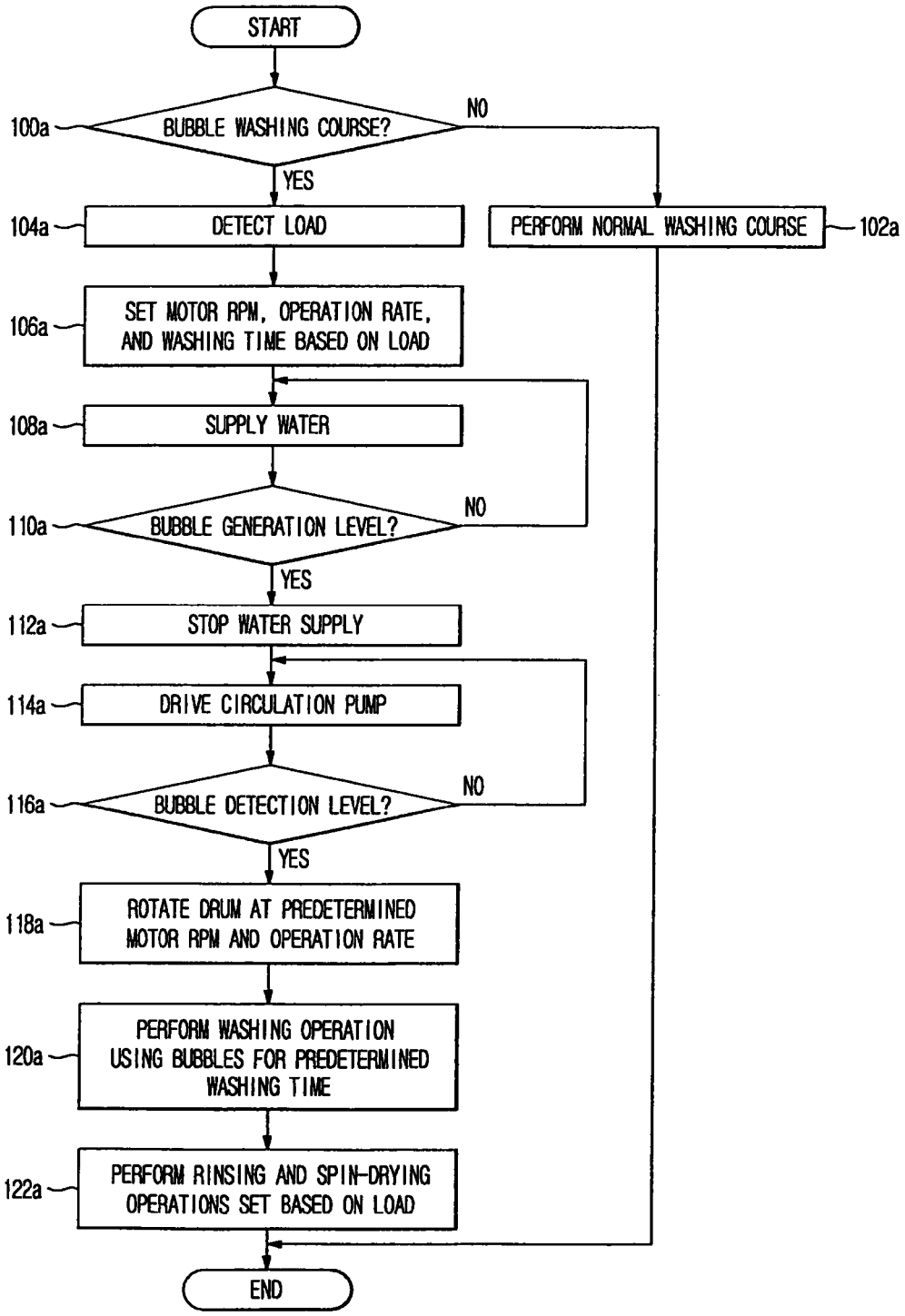
FIG. 16 is a flow chart illustrating a bubble washing control process of the washing machine of FIG. 8.

FIG. 16 is a flow chart illustrating a bubble washing control process of the washing machine of FIG. 8, which is an algorithm to effectively transmit detergent water to laundry placed in the drum 12*a* while minimizing the amount of water used through washing using bubbles.

When a user puts laundry into the drum 12*a* and selects operation information, such as a bubble washing course, spin-drying RPM, and additional rinsing, the operation information selected by the user is input to the controller 72*a* through the signal input unit 70*a*.

The controller 72*a* determines whether the washing course selected by the user is a bubble washing course based on the operation information input from the input unit 70*a* (100*a*). When the washing course selected by the user is not the bubble washing course, a normal washing course is performed in the same manner as a conventional washing course (102*a*).

When the washing course selected by the user is the bubble washing course, the controller 72*a* detects the load (the weight of the laundry) placed in the drum 12*a* (104*a*), and sets motor RPM, motor operation rate, and washing time based on the detected load (106*a*).

Subsequently, the controller 72*a* controls the water supply valve 34*a* to supply detergent water necessary to generate bubbles such that water (specifically, wash water) is supplied into the water tub 11*a* through the detergent supply device 20*a* via the first water supply pipe 32*a*. At this time, detergent in the detergent supply device 20*a* is dissolved in the supplied water (wash water), and is supplied into the water tub 11*a* through the water supply nozzle 35*a* via the second water supply pipe 33*a* together with the water (wash water). As a result, the detergent water (water+detergent) is supplied into the lower part of the water tub 11*a* (specifically, between the water tub and the drum) (108*a*).

At this time, the level of the supplied detergent water is detected by the level detection unit 18*a* to determine whether the level is a predetermined bubble generation level (for example, a level 5 cm or less higher than the bottom of the drum) (110*a*). When the level is not the bubble generation level, detergent water is continuously supplied until the level reaches the bubble generation level. When the level is the bubble generation level, the controller 72*a* controls the water supply valve 34*a* to be turned off such that the supply of water is stopped (112*a*).

When the supply of the detergent water to the bubble generation level is completed, the controller 72*a* controls the circulation pump 51*a* to generate bubbles in the detergent water supplied to the lower part of the water tub 11*a* (702*a*). A process of generating bubbles by the circulation pump 51 is the same as the above description with reference to FIGS. 9 to 13.

When the circulation pump 51*a* is driven, water in the water tub 11*a* is guided to the pump case 40*a* through the connection hose 41*a*. The water guided to the pump case 40*a* is resupplied to the lower part of the water tub 11*a* through the circulation pipe 52*a*. In this way, water circulation is achieved. When the water passes through the circulation nozzle 53*a* via the circulation pipe 52*a*, the water pressure is suddenly lowered. As a result, air is naturally introduced into the circulation nozzle 53*a* through the air introduction hole 54*a* and injects air bubbles into the water (detergent water) supplied to the lower part of the water tub 11*a* to form bubbles as mixtures of detergent and air bubbles at the surface of the detergent.

The bubbles as the mixtures of the detergent and the air bubbles start to rise in the drum 12*a*. After a predetermined time (about three minutes), the bubbles are dispersed throughout the drum 12*a* to raise the level. At this time, the level is detected by the level detection unit 18*a* to determine whether the level is a bubble detection level (for example, a level higher than the level of the laundry) (116*a*). When the level is not the bubble detection level, the circulation pump 51*a* is continuously driven until the level reaches the bubble detection level.

When the level has reached the bubble detection level due to the generation of bubbles, the controller 72*a* controls the drum 12*a* to be rotated at the motor RPM and operation rate set to perform a washing operation using bubbles such that the high-concentration detergent on the surfaces of the bubbles surrounds the laundry placed in the drum 12*a* and is absorbed into the laundry (118*a*).

In addition, the controller 72*a* counts bubble generation time. When it is determined that a predetermined time has elapsed as a result of counting the bubble generation time, the controller 72*a* controls the drum 12*a* to be rotated at the motor RPM and operation rate set to perform a washing operation using bubbles such that the high-concentration detergent on the surfaces of the bubbles surrounds the laundry placed in the drum 12*a* and is absorbed into the laundry.

That is, the controller 72*a* controls the drum 12*a* to be rotated with the generation of the bubbles such that the washing operation is performed for a predetermined washing time to effectively and rapidly remove contaminants from the laundry using the high-concentration detergent on the surfaces of the bubbles dispersed throughout the drum 12*a* (120*a*). Meanwhile, the controller 72*a* controls the generation of bubbles to be stopped or continued during the rotation of the drum 12*a*.

When the washing operation using the bubbles is completed, the controller 72 performs rinsing and spin-drying operations set based on the load to end the washing (122*a*).

In this embodiment, the circulation pump 51*a* and drainage pump 61*a* are mounted at the pump case 40*a* in a symmetrical fashion, to which, however, embodiments of the present invention are not limited. For example, the circulation pump 51*a* and drainage pump 61*a* may be mounted side by side at the lower front of the machine body 10*a*. Also, the circulation pump 51*a* and drainage pump 61*a* may be applied to any structures to circulate and drain water.

In this embodiment, the water tub 11*a* is installed in parallel to an installation plane of the washing machine, to which, however, embodiments of the present invention are not limited. For example, the water tub 11*a* may be installed at a predetermined angle to the installation plane of the washing machine.

Figure 17:
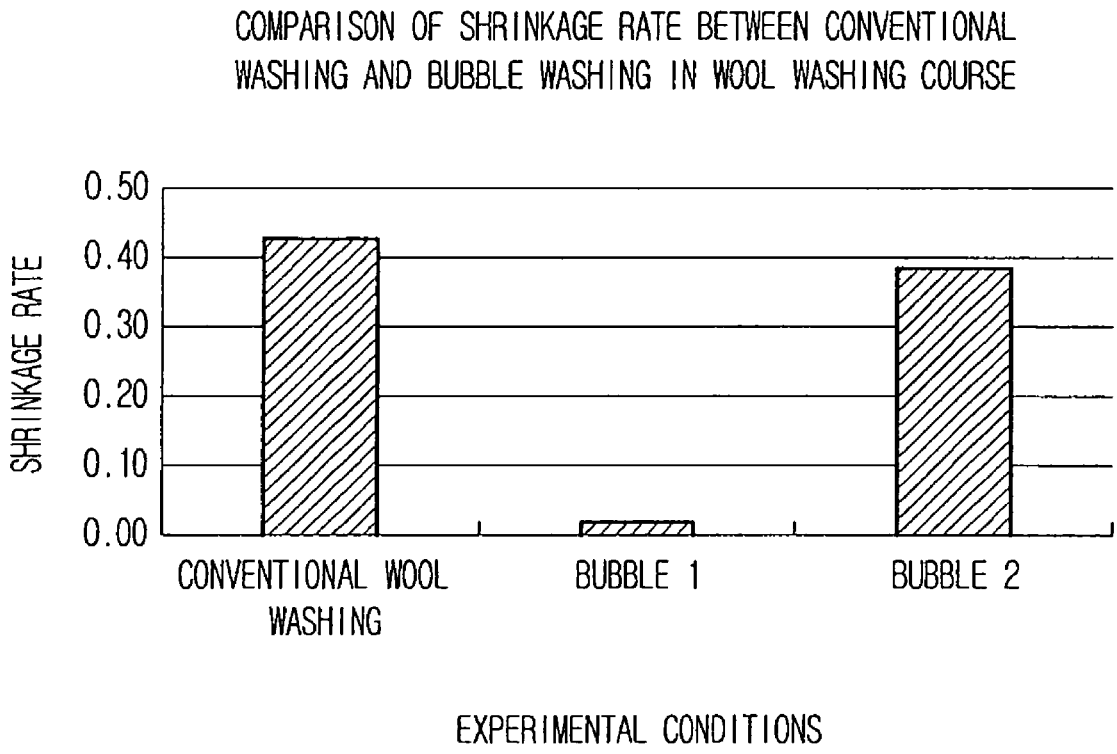
FIG. 17 is a graph illustrating a shrinkage rate of laundry when washing the laundry in such a way as to reduce an amount of water and using bubbles at the same concentration in the same washing operation.
Figure 18:
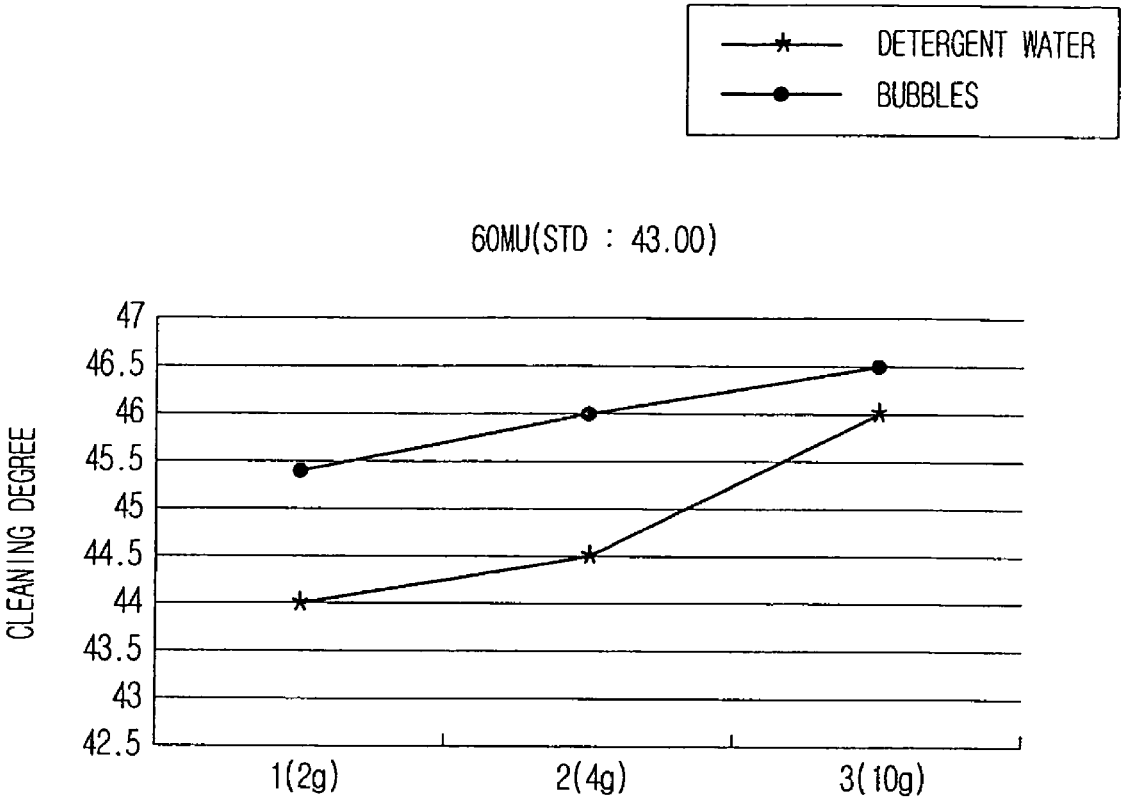
FIG. 18 is a graph illustrating a cleaning degree of artificially contaminated laundry of 60 MU (Make Up), comparing a case of using detergent water with a case of using bubbles at the same detergent concentration.

Results of the bubble washing operation are shown in FIGS. 17 and 18.

FIG. 17 is a graph illustrating a shrinkage rate of laundry when washing the laundry in such a way as to reduce an amount of water and using bubbles at the same concentration in the same washing operation.

In FIG. 17, "Conventional wool washing" indicates a shrinkage rate of wool when a washing operation is performed at an RPM of 25 and at an operation rate of 1 second-On and 78 seconds-OFF for a washing period of 10 minutes, "Bubble 1" indicates a shrinkage rate of wool when the washing operation is performed at an RPM of 25 and at an operation rate of 1 second-On and 78 seconds-OFF for a washing period of 10 minutes as in the conventional wool washing, and "Bubble 2" indicates a shrinkage rate of wool when the washing operation is performed at an RPM of 25 and at an operation rate of 2 seconds-On and 78 seconds-OFF for a washing period of 10 minutes, which is different from the conventional wool washing in terms of operation rate.

FIG. 17 reveals that Bubble 1 exhibits a noticeably reduced shrinkage rate of the laundry as compared with the conventional wool washing, and Bubble 2 exhibits a reduced shrinkage rate of the laundry as compared with the conventional wool washing in spite of its higher operation rate than that of the conventional wool washing.

FIG. 18 is a graph illustrating a cleaning degree of artificially contaminated laundry of 60 MU (Make Up), in terms of reflective index (%) at the same amount (2 g, 4 g, 10 g) of detergent, comparing a case of using detergent water with a case of using bubbles, both of which have the same detergent concentration.

FIG. 18 reveals that the cleaning degree of the laundry through the washing operation using the bubbles is noticeably higher than that using the general detergent water.

As is apparent from the above description, the control method of the washing machine according to the embodiment of the present invention may generate a large number of bubbles using a small amount of water to reduce water consumption and transmit detergent water to laundry placed in the washing machine effectively and rapidly using high-concentration detergent on the surfaces of the bubbles, thereby reducing time and energy consumption and improving washing efficiency.

The bubbles may act as a cushion to reduce friction between laundry articles, thereby preventing expensive laundry (such as wool or silk) from being damaged due to the friction between the laundry articles and between the laundry and water and preventing damage to and deformation of general laundry when washing the laundry.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A control method of a washing machine, comprising:

supplying water and detergent into a water tub to form detergent water;

generating air bubbles including the detergent by use of the detergent water, generating the air bubbles comprising injecting the air bubbles into a space between the water tub and the drum through a circulation channel to circulate the detergent water to generate bubbles;

dispersing the air bubbles injected into the space between the water tub and the drum into the drum through holes formed in the drum;

detecting the level defined by the bubbles, detecting the level comprising detecting frequency variation depending upon the amount of water in the water tub;

stopping generation of the bubbles and rotating a drum when the level defined by the bubbles reaches a predetermined bubble detection level; and washing laundry using the bubbles, wherein the air bubbles injected into the space between the water tub and the drum rise to the surface of the detergent water between the water tub and the drum to form bubbles, and the bubbles are dispersed to a lower portion of the drum through the holes formed in the drum while moving up to an upper part of the space between the water tub and the drum.

2. The control method according to claim 1, further comprising detecting a level of the detergent water initially supplied into the water tub, wherein a supply of the detergent water is stopped when the level of the detergent water reaches the predetermined bubble generation level.

3. The control method according to claim 2, wherein the bubble generation level is a level to generate bubbles while not wetting at least some of the laundry.

4. The control method according to claim 3, wherein the bubble generation level is a level about 5 cm or less higher than a bottom of the drum in which the laundry is placed.

5. The control method according to claim 4, wherein the level of the detergent water is lowered to below the bottom of the drum when the generation of the bubbles is stabilized.

6. The control method according to claim 1, wherein the generating the bubbles comprises generating bubbles at a surface of the detergent water through combination between the air bubbles dispersed into the drum and the detergent.

7. The control method according to claim 6, wherein the generating the bubbles comprises generating the bubbles to raise a level defined by the bubbles such that the level defined by the bubbles is higher than that of the detergent water initially supplied into the water tub.

8. The control method according to claim 7, further comprising counting bubble generation time, wherein generation of the bubbles is stopped when a predetermined time has elapsed as a result of counting the bubble generation time.

9. The control method according to claim 1, wherein the bubble detection level is a level to sufficiently wet the laundry.

* * * * *